US007154466B2

(12) United States Patent
Osame et al.

(10) Patent No.: US 7,154,466 B2
(45) Date of Patent: Dec. 26, 2006

(54) SEMICONDUCTOR DISPLAY DEVICE AND METHOD OF DRIVING THE SAME

(75) Inventors: Mitsuaki Osame, Kanagawa (JP); Yukio Tanaka, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 122 days.

(21) Appl. No.: 11/052,143

(22) Filed: Feb. 7, 2005

(65) Prior Publication Data

US 2005/0156853 A1 Jul. 21, 2005

Related U.S. Application Data

(62) Division of application No. 09/772,725, filed on Jan. 30, 2001, now Pat. No. 6,856,307.

(30) Foreign Application Priority Data

Feb. 1, 2000 (JP) ..... 2000-024471

(51) Int. Cl.
*G09G 3/36* (2006.01)

(52) U.S. Cl. ..... 345/98; 345/100

(58) Field of Classification Search ..... 345/98, 345/100, 204, 211, 212; 326/56–58; 438/149; 327/437

See application file for complete search history.

(56) References Cited

U.S. PATENT DOCUMENTS 5,198,699 A 3/1993 Hashimoto et al. ..... 327/108
5,220,205 A 6/1993 Shigehara et al. ..... 327/198
5,633,599 A 5/1997 Kubota ..... 326/16
5,643,826 A 7/1997 Ohtani et al. ..... 437/88
5,923,962 A 7/1999 Ohtani et al. ..... 438/150
5,936,455 A 8/1999 Kobayashi et al. ..... 327/437
6,052,104 A 4/2000 Lee ..... 345/92
6,124,840 A 9/2000 Kwon ..... 345/100

FOREIGN PATENT DOCUMENTS

JP 07-130652 5/1995
JP 08-078329 3/1996
JP 10-135468 5/1998
JP 10-135469 5/1998

*Primary Examiner*—Ricardo Osorio
(74) *Attorney, Agent, or Firm*—Cook, Ales, McFarron, Manzo, Cummings & Mehler, Ltd.

(57) ABSTRACT

In executing the opposing common inverse drive in an active matrix-type semiconductor display device, a gate bias is suppressed to be comparable with that of the conventional inverse drive to avoid a range in which the off current jumps up and, hence, to suppress the leakage of the stored electric charge, thereby to maintain an ON/OFF margin of the pixel TFTs. The gate bias applied to the pixel TFT is maintained to be near the customarily employed voltage to maintain a gate breakdown voltage, and the electric power is consumed in a decreased amount by the drive circuit as a whole, thereby to provide a novel drive circuit. In the semiconductor display device, a tristate buffer is used for a gate signal line drive circuit, and different buffer potentials are applied depending upon a frame in which the opposing common potential assumes a positive sign and a frame in which the opposing common potential assumes a negative sign, thereby to maintain an ON/OFF margin of the pixel TFTs. The voltage amplitude is decreased during the opposing common inverse drive.

10 Claims, 28 Drawing Sheets

SEMICONDUCTOR DISPLAY DEVICE AND METHOD OF DRIVING THE SAME

This application is a divisional of U.S. application Ser. No. 09/772,725, filed on Jan. 30, 2001 now U.S. Pat. No. 6,856,307.

BACKGROUND OF THE INVENTION

1. Field of the Invention

This invention relates to a semiconductor display device and to a method of driving the semiconductor display device. More particularly, the invention relates to an active matrix-type semiconductor display device having thin-film transistors (TFTs) fabricated on an insulating substrate, and a method of driving the active matrix-type semiconductor display device. In particular, the invention relates to an active matrix-type liquid crystal display device among the active matrix-type semiconductor display devices and to a method of driving the active matrix-type liquid crystal display device.

2. Description of the Related Art

In recent years, technology has been rapidly developed for fabricating TFTs by forming a semiconductor thin film over a cheaply available glass substrate. The reason is due to an increased demand for the active matrix-type liquid crystal display devices (liquid crystal panels).

An active matrix-type liquid crystal display device is the one in which pixel TFTs are arranged in several tens of thousands to several millions of pixel regions arranged like a matrix (this circuit is called active matrix circuit), and the electric charges going into, and coming out from, the pixel electrodes of the pixel regions are controlled by a switching function of pixel TFTs.

The active matrix circuit has heretofore been employing TFTs of amorphous silicon formed over a glass substrate.

In recent years, there has been realized an active matrix-type liquid crystal display device having TFTs using a polycrystalline silicon film formed on a quartz substrate. In this case, a peripheral drive circuit for driving the pixel TFTs can be fabricated over the same substrate as the active matrix circuit.

There has also been known technology for fabricating TFTs by forming, a polycrystalline silicon film over a glass substrate by utilizing such technology as laser annealing. This technology makes it possible to form the active matrix circuit and the peripheral drive circuit in an integrated manner over the same glass substrate.

In recent years, the active matrix-type liquid crystal display device has frequently been used as a display of personal computers. The active matrix-type liquid crystal display device of a large screen has been used for desktop personal computers, too, in addition to notebook personal computers.

Attention has also been given to a projector using a small active matrix-type liquid crystal display device which features sharp image, high resolution and high image quality. Particularly, a projector for high vision capable of displaying image maintaining a higher resolution is drawing attention.

Here, the liquid crystal display device must execute an inverse drive to prevent the liquid crystal elements from being deteriorated. Concretely speaking, as shown in FIG. 3A, a video signal is inverted from positive to negative after every frame period with a potential of an opposing electrode (hereinafter referred to as opposing common potential, $V_{COM}$) as a center potential (constant value). Usually in this case, a source signal line drive circuit is driven with a voltage having an amplitude slightly broader than the amplitude of the video signal in order to reliably write the video signals into the source signal line. This is because the analog switch has been constituted by a pair of N-channel TFT and P-channel TFT, a current at the time of writing the signal must be large enough to reliably write the signal into the source signal line, and the switch must be reliably turned off to prevent the leakage of electric charge once written into the source signal line from the analog switch. Usually, the ON/OFF margin of the analog switch is about 3 [V] by taking a threshold value $+\alpha$ of the TFTs into consideration. Concretely speaking, when the amplitude of the video signal written into the source signal line is ±5 [V], the amplitude of the drive voltage of the source signal line drive circuit (analog switch) becomes ±8 [V]. A gate signal line drive circuit, too, is driven with an amplitude of ±8 [V] in order to maintain a voltage across gate and source of the pixel TFT by taking the threshold value into consideration.

Here, if attention is given to the electric power consumed in driving the liquid crystal display device, the buffer unit of the source signal line drive circuit consumes a large proportion of electric power among the electric power consumed by the whole display device. Therefore, if the consumption of electric power could be decreased by lowering the drive voltage of the source signal line drive circuit, then, the consumption of electric power by the whole display device can be greatly decreased.

According to the above inverse drive system, for example, the drive voltage is ±8 [V](16 [V]) when $V_{COM}$ is 0 [V] constant and the amplitude of the video signal is from −5 to 5 [V](10) [V]) by taking the ON/OFF margin (3 [V]) of the analog switch into consideration.

Considered below is a method of inverting $V_{COM}$ from positive to negative relative to a video signal that is inverted from positive to negative for every frame period. Referring to FIG. 3B, the video signal is 2.5 [V] in a given frame, the opposing $V_{COM}$ is −2.5 [V] in a given frame and in a next frame, the video signal is −2.5 [V] and the opposing $V_{COM}$ is 2.5 [V]. In each frame, the voltage applied to the liquid crystal element is 5 [V], i.e., a potential difference between the video signal and $V_{COM}$ is 5 [V] like in an ordinary case, though the video signal has an amplitude of from −2.5 to 2.5 [V](5 [V]). When the ON/OFF margin of the analog switch is considered to be 3 [V] like in the above case, therefore, the drive voltage becomes ±5.5 [V](11 [V]), and the consumption of electric power can be decreased by about 47 [%].

Further, in the source signal line drive circuit, in general, the TFT must have a large current ability since the source signal line has a large capacitive load and the drive frequency is high. Accordingly, the TFTs constituting the source signal line drive circuits, usually, have a small gate width (L) and a large channel length (W). Therefore, these TFTs are likely to be more deteriorated than other TFTs. A decrease in the buffer voltage of the source signal line drive circuits by 5 [V] is equal to improving the reliability of TFTs in the source signal line drive circuits.

On the other hand, the opposing common inverse drive causes an increase in the burden on the gate signal line drive circuits and on the pixel TFTs. In the pixel portion, the opposing electrode and the source region of the pixel TFT (in the pixel TFT, hereinafter, the region on the side connected to the source signal line is defined as the drain region and the region on the side connected to the liquid crystal element is defined as the source region, this positional relationship is maintained even when the potential of the video signal is inverted) are coupled together through capacity with a liquid crystal element sandwiched therebetween.

When this capacity is dominating compared to other capacities in the drive circuit unit, a change in the $V_{COM}$ in a state where the pixel TFT is off is accompanied by an equal amount of change in the potential in the source region of the pixel TFT in order to preserve the potential difference across the electrodes of the capacity. Concretely speaking, when a voltage applied to the liquid crystal element is from −5 to 5 [V] while $V_{COM}$ $V_{COM}$=−2.5 [V], the potential in the source region of the pixel TFT could become from −7.5 to 2.5 [V]. When the voltage applied to the liquid crystal element is from −5 to 5 [V] while $V_{COM}$=2.5 [V], the potential in the source region of the pixel TFT could become from −2.5 to 7.5 [V] (FIGS. 3C and 3D).

When the drive voltage amplitude of the gate signal line drive circuit is ±8 [V] in this state, the ON/OFF margin of the pixel TFT becomes 0.5 [V], and normal operation is not often accomplished depending upon the threshold value of the pixel TFT. To maintain a margin of 3 [V] like in the source signal line drive circuit; the amplitude of the drive voltage of the gate signal line drive circuit must be ±10.5 [V] like in FIG. 3E.

Thus, the voltage increases across gate and source of the pixel TFT. Reference is now made to FIG. 4A. When $V_{COM}$ has an amplitude of ±2.5 [V], the potential in the source region of the pixel TFT could become from −7.5 to 7.5 [V]. At this moment, the potential which the gate electrode could assume is ±10.5 [V]. It is therefore considered that the voltage across gate and source of the pixel TFT is from −18 to +18 [V].

FIG. 5 illustrates voltage-current characteristics of an N-channel TFT, wherein the abscissa represents a voltage ($V_{GS}$) across gate and source and the ordinate represents a drain current ($I_D$). When a large inverse bias voltage (a voltage of the gate electrode of a potential lower than the potential of the source region) is applied to the gate electrode, the drain current often increases suddenly. That is, when the voltage across gate and source is −18 [V] in the pixel TFT, the stored electric charge leaks through the pixel TFT that has been turned off. Besides, when such a large voltage is applied across gate and source, a problem arouses concerning the gate breakdown voltage. Because of this problem, the opposed common inverse drive system has not been almost put into practice and, instead, the ON/OFF margin of the pixel TFT is cut and $V_{COM}$ is permitted to possess only a small degree of amplitude.

SUMMARY OF THE INVENTION

This invention was accomplished in view of the above-mentioned problem, and has the object of realizing an opposing common inverse drive while suppressing an increase in the amplitude of a buffer voltage of the gate signal line drive circuit by employing a novel drive circuit and a novel drive method. The invention further has an object of decreasing the amount of electric power consumed by the whole liquid crystal display device by lowering the drive voltage of the source signal line drive circuit while maintaining a conventionally employed gate bias voltage applied to the pixel TFT (maintaining the gate breakdown voltage).

In order to decrease the inverse bias voltage applied across the gate and the source of a pixel TFT according to this invention, different potentials are applied as the Lo potentials of the gate signal line drive circuit depending upon a frame period in which $V_{COM}$ is Hi (2.5 [V]) and a frame period in which $V_{COM}$ is Lo (−2.5 [V]).

Here, the drive voltage of the gate signal line drive circuit is such that the high-voltage side potential $V_{HI}$ is 10.5 [V] and the low-voltage side potential $V_{LO}$ is −10.5 [V]. Further, a potential of −5.5 [V] is provided as $V_{LO2}$. These potentials may have a relationship $V_{LO}<V_{LO2}<V_{HI}$, and the pixel TFT should be reliably turned off with the gate potential $V_{LO2}$.

In this invention, when $V_{COM}$=−2.5 [V], the amplitude of the drive voltage of the gate signal line drive circuit is ±10.5 [V] by using $V_{HI}$ and $V_{LO}$ as shown in FIG. 4B. When $V_{COM}$=2.5 [V], the amplitude of the drive voltage of the gate signal line drive circuit is from −5.5 to 10.5 [V] by using $V_{HI}$ and $V_{LO2}$ as shown in FIG. 4C. In a frame in which $V_{COM}$ assumes any potential, therefore, a maximum inverse bias voltage applied across the gate and the source of a pixel TFT becomes −13 [V], and the leakage of an off current is suppressed to a large extent.

Next, described below is the constitution of this invention.

A semiconductor display device of the invention comprises:

a source signal line drive circuit unit constituted by plural thin-film transistors;

a gate signal line drive circuit unit constituted by plural thin-film transistors; and a pixel unit in which plural pixel thin-film transistors are arranged like a matrix; wherein, the gate signal line drive circuit has at least one tristate buffer per a gate signal line;

the tristate buffer has:

a first circuit that includes a pair of n-channel thin-film transistor and p-channel thin-film transistor; and a second circuit that includes a pair of n-channel thin-film transistor and p-channel thin-film transistor;

the source region of the n-channel thin-film transistor in the first circuit is electrically connected, at a first connection point, to the source region of the p-channel thin-film transistor of the second circuit;

a first power source is electrically connected to the source region of the p-channel thin-film transistor of the first circuit;

a second power source having a potential lower than that of the first power source is electrically connected to the first connection point;

a third power source having a potential lower than the second power source is electrically connected to the source region of the n-channel thin-film transistor of the second circuit; and an output signal line of the first circuit and an output signal line of the second circuit are both electrically connected to the gate signal line at a second connection point.

A semiconductor display device of the another invention comprises:

a source signal line drive circuit unit constituted by plural thin-film transistors;

a gate signal line drive circuit unit constituted by plural thin-film transistors; and a pixel unit in which plural pixel thin-film transistors are arranged like a matrix; wherein, the gate signal line drive circuit has at least one tristate buffer per a gate signal line;

the tristate buffer has:

a first circuit that includes a pair of n-channel thin-film transistor and p-channel thin-film transistor; and a second circuit that includes a pair of n-channel thin-film transistor and p-channel thin-film transistor;

the source region of the n-channel thin-film transistor in the first circuit-is electrically connected, at a first connection point, to the source region of the p-channel thin-film transistor of the second circuit;

a first power source is electrically connected to the source region of the p-channel thin-film transistor of the first circuit;

a second power source having a potential lower than that of the first power source is electrically connected to the first connection point;

a third power source having a potential lower than the second power source is electrically connected to the source region of the n-channel thin-film transistor of the second circuit;

an output signal line of the first circuit and an output signal line of the second circuit are both electrically connected to the gate signal line at a second connection point;

a gate signal line selection pulse is input to the gate of the p-channel thin-film transistor of the first circuit;

a first signal is input to the gate of the n-channel thin-film transistor of the first circuit;

a second signal is input to the gate of the p-channel thin-film transistor of the second circuit;

a third signal is input to the gate of the n-channel thin-film transistor of the second circuit;

when a frame period in which the opposing electrode assumes a high potential is regarded to be a first frame period and a frame in which the opposing electrode has a low potential is regarded to be a second frame period during the opposing common inverse drive, the third signal is input during a fly-back period of when the first frame period is being changed over to the second frame period;

the second signal is input just before the gate signal line selection pulse is input; and the first signal is input during a period of from when the gate signal line selection pulse is output in the second frame period until when the second signal is output in the first frame period, and during a period of from when the gate signal line selection pulse is output in the first frame period until when the third signal is input in the fly-back period.

A semiconductor display device of the another invention is the semiconductor display device, wherein the first signal is obtained by directly inputting a signal from an external unit.

A semiconductor display device of the another invention is the semiconductor display device, wherein the first signal is the one output from a logic circuit that receives the gate signal line selection pulse and the third signal.

A semiconductor display device of another invention is the semiconductor display device, wherein the first signal is the one output from a logic circuit that receives any one of the signals or plural signals fed to the gate signal line drive circuit from an external unit.

A semiconductor display device of the another invention is the semiconductor display device, wherein the first signal is the one output from a NOR circuit by inputting the gate signal line selection pulse and the third signal to a reset/set flip-flop circuit and, then, by inputting the output of the reset/set flip-flop circuit and the gate signal line selection pulse to the NOR circuit.

A semiconductor display device of the another invention is the semiconductor display device, wherein the second signal is obtained by directly inputting a signal from an external unit.

A semiconductor display device of the another invention is the semiconductor display device, wherein the second signal is a gate signal line selection pulse output to a stage preceding the gate signal line selection pulse.

A semiconductor display device of the another invention is the semiconductor display device, wherein the third signal is obtained by directly inputting a signal from an external unit.

A semiconductor display device of the another invention comprises:

a source signal line drive circuit unit constituted by plural thin-film transistors;

a gate signal line drive circuit unit constituted by plural thin-film transistors; and a pixel unit in which plural pixel thin-film transistors are arranged like a matrix; wherein, the gate signal line drive circuit has at least one tristate buffer per a gate signal line:

the tristate buffer has:

a first circuit that includes a pair of n-channel thin-film transistor and p-channel thin-film transistor;

a second circuit that includes a pair of n-channel thin-film transistor and p-channel thin-film transistor;

a reset/set flip-flop circuit; and a NOR circuit;

the source region of the n-channel thin-film transistor in the first circuit is electrically connected, at a first connection point, to the source region of the p-channel thin-film transistor of the second circuit;

a first power source is electrically connected to the source region of the p-channel thin-film transistor of the first circuit;

a second power source having a potential lower than that of the first power source is electrically connected to the first connection point;

a third power source having a potential lower than the second power source is electrically connected to the source region of the n-channel thin-film transistor of the second circuit;

an output signal line of the first circuit and an output signal line of the second circuit are both electrically connected to the gate signal line at a second connection point;

a gate signal line selection pulse is input to the gate of the p-channel thin-film transistor of the first circuit;

a first signal is input to the gate of the n-channel thin-film transistor of the first circuit;

a second signal is input to the gate of the p-channel thin-film transistor of the second circuit:

a third signal is input to the gate of the n-channel thin-film transistor of the second circuit;

when a frame period in which the opposing electrode assumes a high potential is regarded to be a first frame period and a frame in which the opposing electrode has a low potential is regarded to be a second frame period during the opposing common inverse drive, the third signal is input during a fly-back period of when the first frame period is being changed over to the second frame period;

the second signal is input just before the gate signal line selection pulse is input; and the first signal is an output signal of a NOR circuit that receives the gate signal line selection pulse and a set output signal obtained by inputting a gate signal line selection pulse to the reset signal input line of the reset/set flip-flop circuit and by inputting the third signal to the set signal input line.

A semiconductor display device of the another invention is the semiconductor display device, wherein the second signal is obtained by directly inputting a signal from an external unit.

A semiconductor display device of the another invention is the semiconductor display device, wherein the second signal is a gate signal line selection pulse output to a stage preceding the gate signal line selection pulse.

A semiconductor display device of the another invention is the semiconductor display device, wherein the third signal is obtained by directly inputting a signal from an external unit.

The another invention is concerned with a method of driving a semiconductor display device which comprises:

a source signal line drive circuit unit constituted by plural thin-film transistors;

a gate signal line drive circuit unit constituted by plural thin-film transistors; and a pixel unit in which plural pixel thin-film transistors are arranged like a matrix;

wherein pixel TFTs constituting an active matrix circuit are driven by using three kinds of potentials which are a first power-source potential, a second power-source potential and a third power-source potential.

DESCRIPTION OF THE PREFERRED EMBODIMENTS

A drive circuit and a drive method of the invention will now be described.

Figure 1:
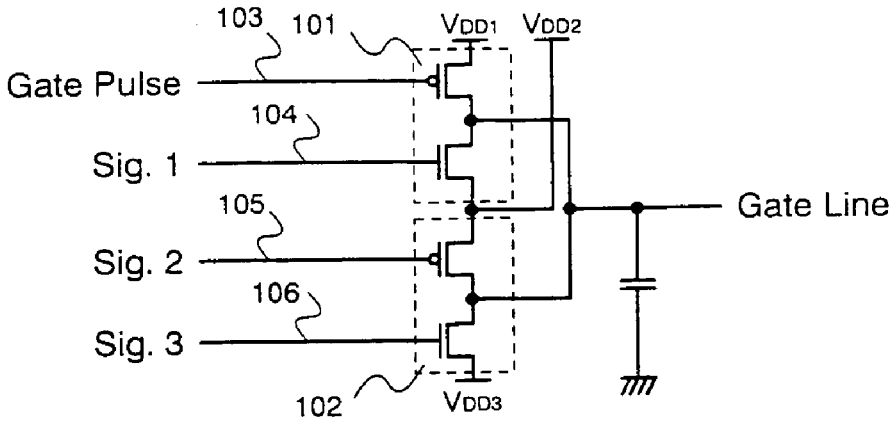
FIG. 1 is a diagram illustrating the circuit constitution of a tristate buffer of this invention and signal inputs.

Reference is made to FIG. 1 which is a circuit diagram of a tristate buffer used in the invention. A first circuit 101 and a second circuit 102 each including a pair of n-channel TFT and p-channel TFT, are connected as shown in FIG. 1.

Power-source potentials connected to the tristate buffer include a first power-source potential $VDD_1$, a second power-source potential $VDD_2$ lower than the first power-source potential, and a third power-source potential $VDD_3$ lower than the second power-source potential, the potential $VDD_1$ being connected to the source region of the p-channel TFT of the first circuit, the potential $VDD_2$ being connected to a connection point of the first circuit and the second circuit, and the potential $VDD_3$ being connected to the source region of the n-channel TFT in the second circuit.

Signals input to the tristate buffer include a first signal (Sig. 1). a second signal (Sig. 2), a third signal (Sig. 3) and a gate signal line selection pulse (gate pulse).

The gate signal line selection pulse is input to the gate electrode of the p-channel TFT in the first circuit, the first signal is input to the gate electrode of the n-channel TFT in the first circuit, the second signal is input to the gate electrode of the p-channel TFT in the second circuit, and the third signal is input to the gate electrode of the n-channel TFT in the second circuit.

In the circuit constitution of the invention using the tristate buffer, when there appears a frame period in which the opposing potential ($V_{COM}$) shifts toward one side, a third signal is input in just the preceding fly-back period, and the potential of the gate signal line is shifted to $VDD_3$ which is on the low-potential side for only a period in which the electric charge is held by the drain side of the pixel TFT. After the third signal is input, the gate signal line potential is fixed to $VDD_3$ due to a holding capacity. Therefore, the pixel TFT is turned off more reliably to thereby reliably hold the electric charge. Further, when a gate signal line selection pulse is output from a gate signal line drive circuit and the potential of the gate signal line is lifted up to the + side, the potential is once lifted up to $VDD_2$ which is an intermediate potential due to the second signal and is, then, lifted up to the $VDD_1$ by the gate signal line selection pulse. Then, in a period in which the gate signal line selection pulse has not been output, $VDD_2$ which is the intermediate potential is fed to the gate signal line. This method makes it possible to decrease the voltage across the source and the drain in the buffer unit in the circuit using the tristate buffer of the invention during the opposing common inverse drive.

The output buffer directly connected to the gate signal line must bear a large load and, hence, must possess the largest current ability among the TFTs in the gate signal line drive circuit. Application of a high source-drain voltage to the buffer is detrimental from the standpoint of reliability. When the device is driven by the above method using the buffer circuit of the invention, the TFTs constituting the output buffer which must bear the largest burden in the gate signal line drive circuit, can be driven by a voltage (across $VDD_1$ and $VDD_2$ or across $VDD_2$ and $VDD_3$) which is lower than the voltage (across $VDD_1$ and $VDD_3$) of during the normal common inversion.

In the tristate buffer used in the gate signal line drive circuit according to the invention, two kinds of Lo potentials are given to the gate signal line depending upon when the opposing common potential is on the + side and on the − side. In this case, the pixel TFTs are n-channel TFTs which usually has the Lo potential (when not selected) and has the Hi potential when selected. When the above two kinds of different Lo potentials are input, therefore, the TFTs are turned off.

Figure 4A:
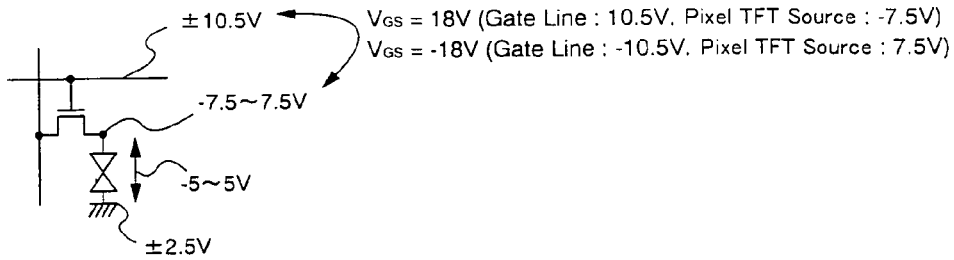
FIGS. 4A to 4C are diagrams illustrating a voltage across the gate and the source of a pixel TFT.
Figure 4B:
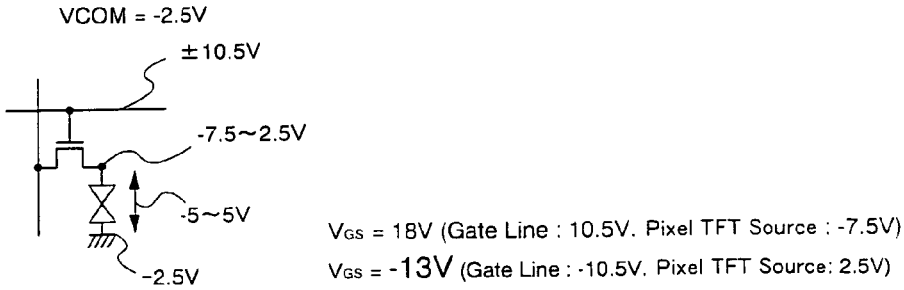
Figure 4C:
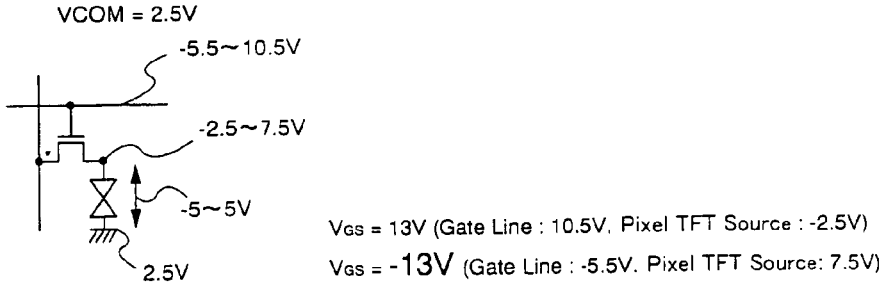

FIG. 4B illustrates $V_{GS}$ of when the pixel TFT is inversely biased with the opposing common potential on the − side and FIG. 4C illustrates $V_{GS}$ of when the pixel TFT is inversely biased with the opposing common potential on the + side.

Figure 5:
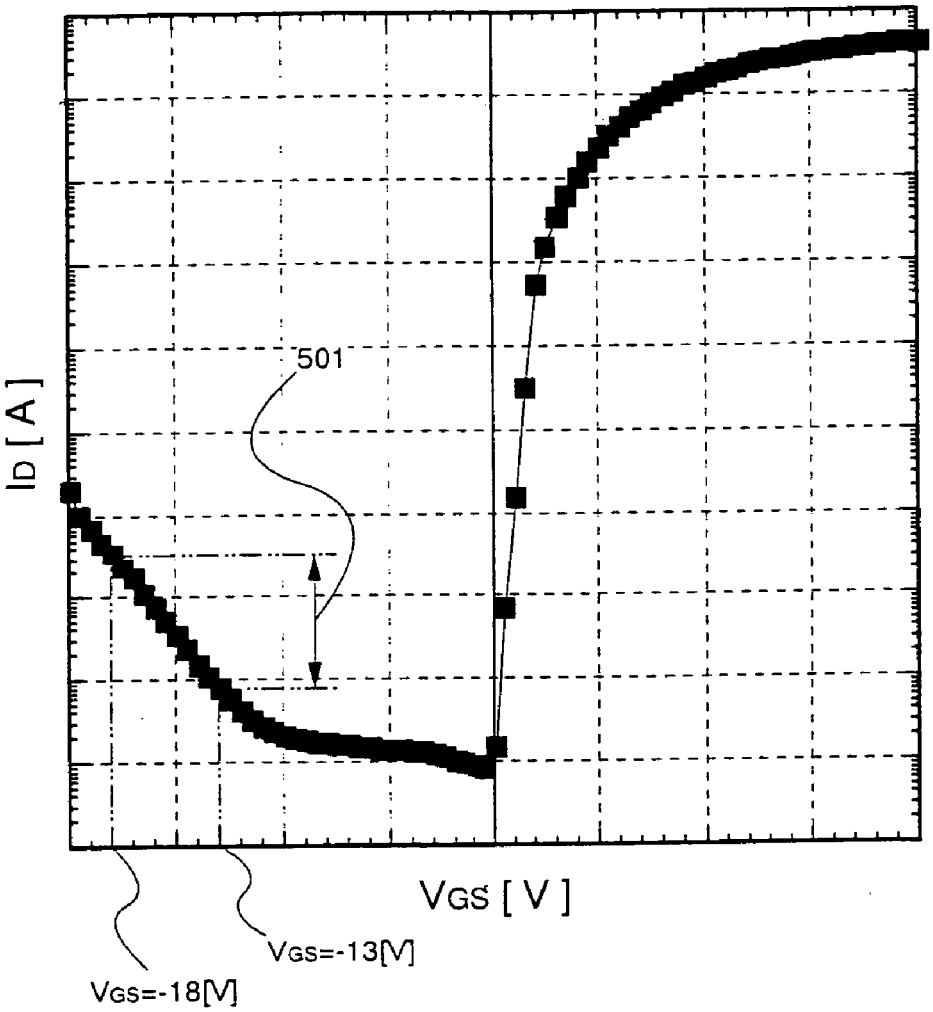
FIG. 5 is a diagram illustrating a relationship between the gate voltage and the drain current of an n-channel TFT.

When the opposing common potential is −2.5 [V], the gate signal line potential becomes −10.5 [V] and $V_{GS}$ at this moment assumes a value of from 18 [V] to −13 [V]. When the opposing common potential is +2.5 [V], the gate signal line potential becomes −5.5 [V] and $V_{GS}$ at this moment assumes a value of from 13 [V] to 13 [V]. If attention is given to a region where $V_{GS}$ becomes negative in FIG. 5, there is a large difference in the value $I_D$ (off leakage current here) as designated at 501 depending upon when $V_{GS}$=−13 [V] and when $V_{GS}$ is −18 [V]. That is, the off leakage current can be thus decreased when the gate is inversely biased. Therefore, the ON/OFF margin of the pixel TFT is sufficiently maintained during the opposing common inverse drive, and the inverse bias applied to the gate is suppressed to be lower than that of during the normal opposing common inverse drive, avoiding the leakage of the electric charge that will be caused by a sudden increase in the off leakage current.

The semiconductor display device and the method of driving the semiconductor display device of the invention will now be described by way of embodiments to which only, however, the invention is in no way limited.

Embodiment 1

As a semiconductor display device that can be fabricated by applying the invention, this embodiment deals with an active matrix-type liquid crystal display device.

Figure 6:
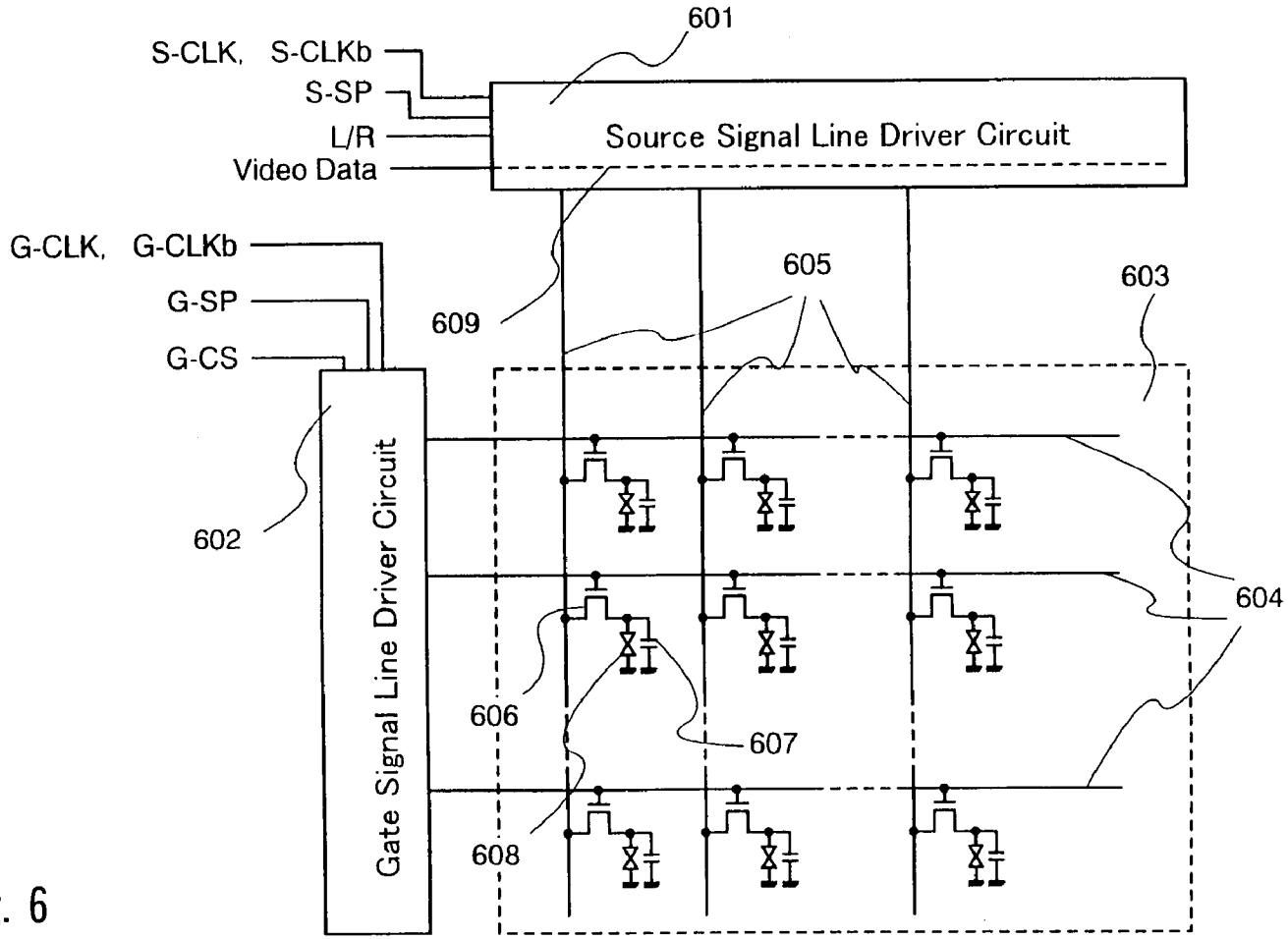
FIG. 6 is a diagram schematically illustrating an active matrix-type semiconductor display device according to an embodiment 1.

Reference is made to FIG. 6 which is a diagram schematically illustrating the active matrix-type liquid crystal display device according to this embodiment, wherein reference numeral 601 denotes a source signal line drive circuit that receives clock signals (S-CLK, S-CLKb), a start pulse (S-SP). a right-and-left scanning direction change-over signal (L/R), video signals (video data) and the like. Reference numeral 602 denotes a gate signal line drive circuit that receives clock signals (G-CLK. G-CLKb), a start pulse (G-SP), buffer control signals (G-CS) and the like. Reference numeral 603 denotes a pixel unit having pixels arranged like a matrix at the intersecting points of the gate signal lines 604 and the source signal lines 605. Each pixel has a pixel TFT 606. A pixel electrode (not shown) and a holder capacity 607 are connected to either the source region or the drain region of the pixel TFT. Reference numeral 608 denotes liquid crystals held between the active matrix circuit and the opposing substrate (not shown). Reference numeral 609 denotes a video signal line which receives video signals (video data) from an external unit.

Figure 7:
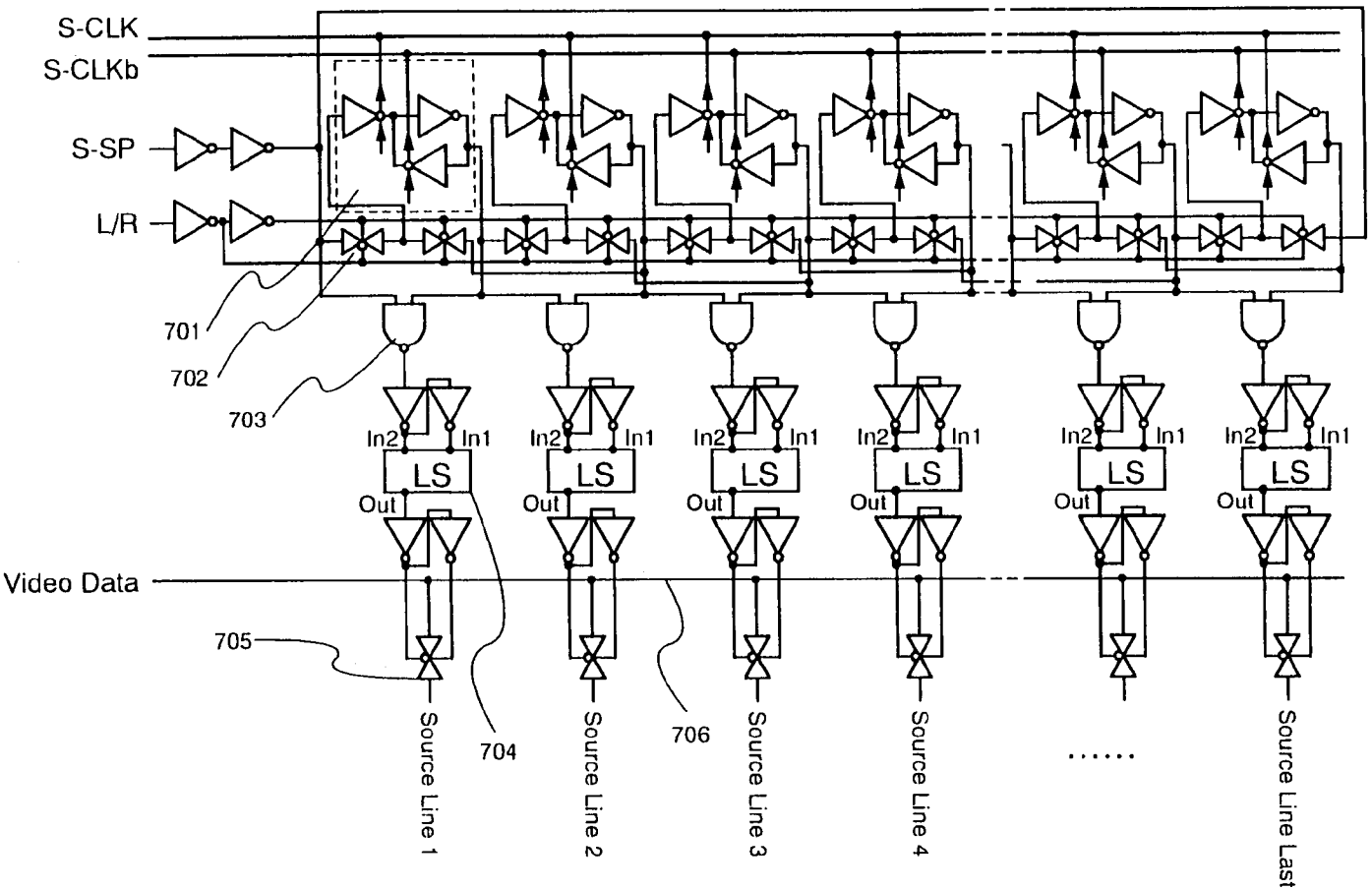
FIG. 7 is a diagram illustrating a source signal line drive circuit in the active matrix-type semiconductor display device according to the embodiment 1.

Reference is made to FIG. 7 which is a diagram illustrating the constitution of the source signal line drive circuit in the active matrix-type liquid crystal display device according to the embodiment constituted by shift registers 701, right-and-left scanning direction change-over analog switches 702, NAND circuits 703, level shifter circuits 704, sampling switches 705, a video signal line 706, and the like.

The source signal line drive circuit receives clock signals (S-CLK), inverted signals (S-CLKb) of clock signals, a start pulse (S-SP) and a right-and-left scanning change-over signal (L/R).

The shift register 701 is operated by clock signals (S-CLK), inverted signals (S-CLKb) of clocks, start pulse (S-SP) and right-and-left scanning change-over signal (L/R). When the right-and-left scanning change-over signal (L/R) of the Hi level is input, signals for sampling the video signals are successively output from the NAND circuits 703 from the left toward the right. The signals for sampling the video signals are shifted for their voltage amplitude toward the high voltage side by the level shifter circuits 704, and are input to sampling switches 705. The sampling switches 705 work to sample the video signals (video data) fed from the video signal line 706 in response to the input of the sampling signals, and send them to the source signal line. Upon driving the pixel TFTs, the video signals input to the source signal line are written into the pixels so as to display an image.

Figure 2:
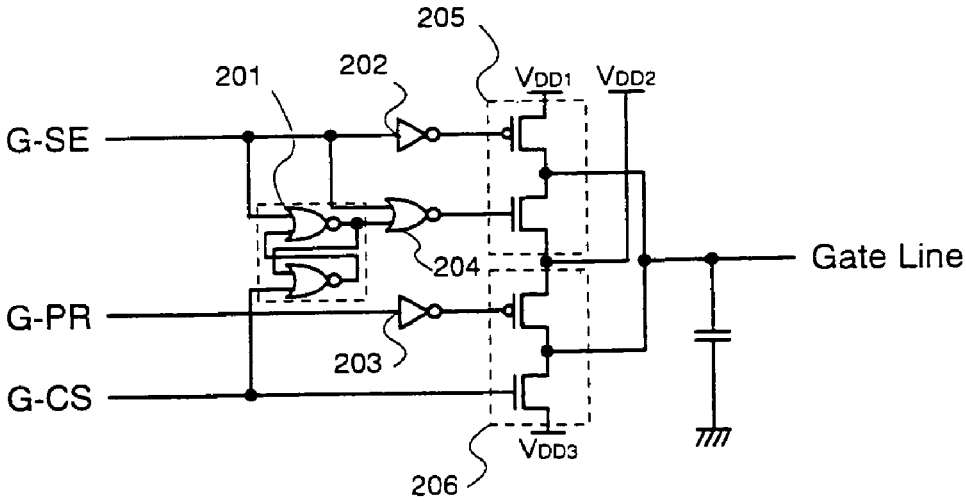
FIG. 2 is a diagram illustrating the circuit constitution of the tristate buffer.
Figure 3A:
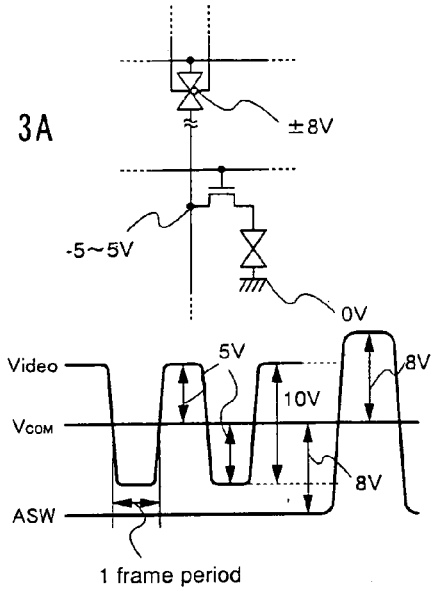
FIGS. 3A to 3E are diagrams illustrating a voltage across the gate and the source of a pixel TFT.
Figure 3B:
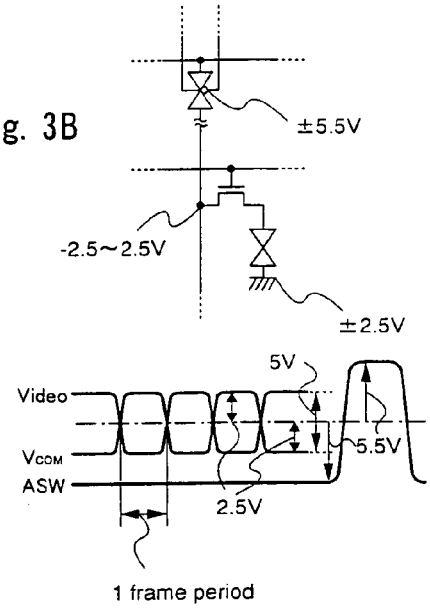
Figure 3C:
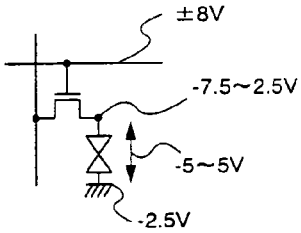
Figure 3D:
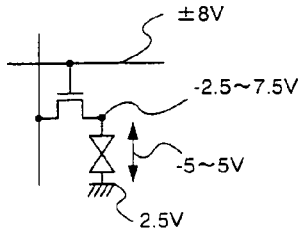
Figure 3E:
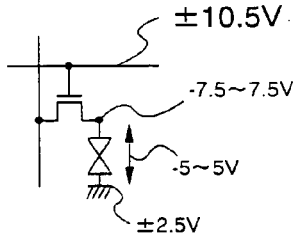

Reference is made to FIG. 2 which illustrates a constitution of the tristate buffer of the invention, including an R-S-FF (reset/set flip-flop) circuit 201, inverters 202, 203, a NOR circuit 204, a first circuit 205 and a second circuit 206.

Described below are the signals input to the tristate buffer arranged in the m-th stage in the scanning direction of the gate signal line drive circuit. In this embodiment, there are input a gate signal line selection pulse of the m-th stage (hereinafter referred to as G-SE), a gate signal line selection pulse of the (m−1)-th stage (hereinafter referred to as G-PR), and a buffer control signal (hereinafter referred to as G-CS) from an external unit.

Figure 8:
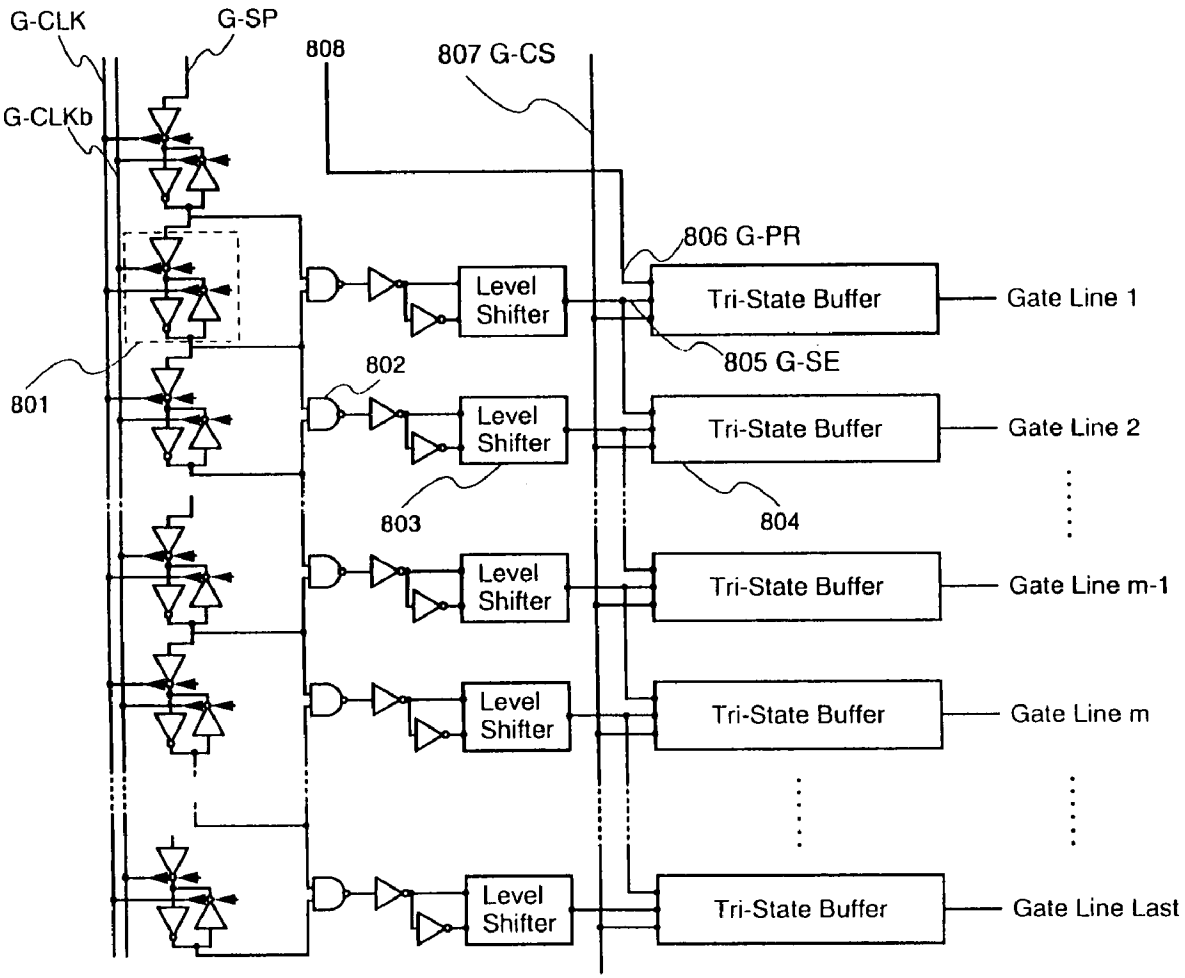
FIG. 8 is a diagram illustrating a gate signal line drive circuit in the active matrix-type semiconductor display device according to the embodiment 1.

Reference is made to FIG. 8 which illustrates a gate signal line drive circuit constituted by tristate buffers of the present invention, and includes shift register circuits 801, NAND circuits 802, level shifter circuits 803, tristate buffers 804, and the like. Depending upon the form of input signals, further, an inverter circuit and a buffer circuit may be arranged among the NAND circuit, level shifter circuit and the buffer circuit.

Clock signals (G-CLK), inverted signals (G-CLKb) of clock signals and a start pulse (G-SP) are input to the gate signal line drive circuit.

Instead of the buffer unit in an ordinary gate signal line drive circuit, the tristate buffer of the invention is disposed for every gate signal line. A gate signal line selection pulse (G-SE) of the m-th stage (for the m-th gate line) is input to the signal line 805. An inverted pulse (G-PR) of the gate selection pulse of the (m−1)-th stage is input to the signal line 806. Further, the buffer control signal (G-CS) is input from an external unit to the signal line 807 directly or through a level shifter.

The G-PR input to the tristate buffer of the first stage of the gate signal line drive circuit, may be input to the signal line 808 shown in FIG. 8, or a suitable pulse may be formed by using a start pulse, a clock signal or the like, and may be input thereto, or a signal from an external unit may be directly input thereto.

The shift register circuit 801 is operated by clock signals (G-CLK) input from an external unit, by inverted signals (G-CLKb) of the clock signals and by a start pulse (G-SP), and pulses are output from the shift registers successively from the upper side toward the lower side. Then, a gate signal line selection pulse is output from the NAND circuit 802. The voltage level is shifted by the level shifter circuit 803 toward the high-voltage side, and is output to the gate signal line through the buffer unit 804.

Figure 9:
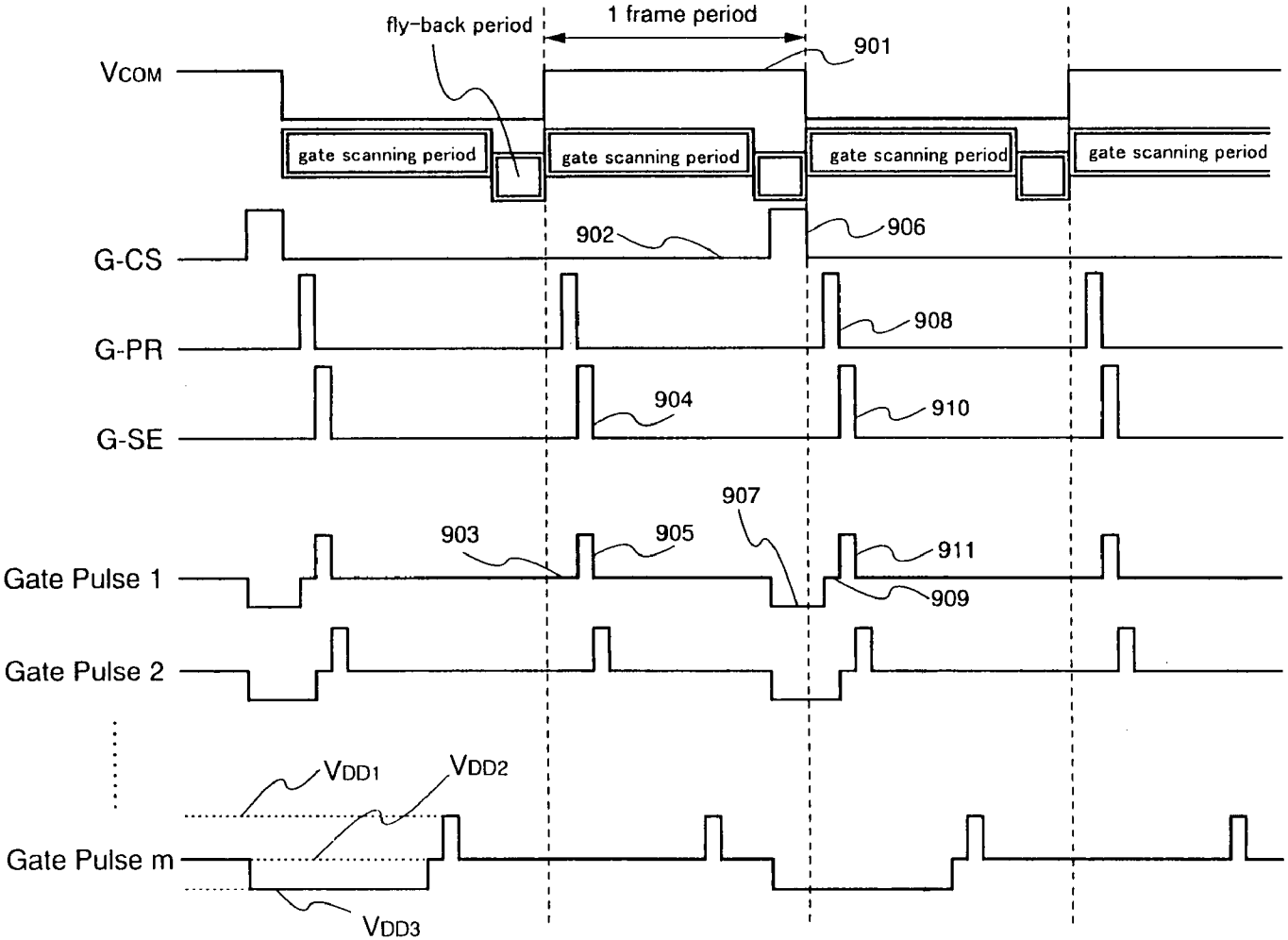
FIG. 9 is a diagram illustrating the timings of signals input to the tristate buffer at the time of opposing common inverse drive and the potentials of the gate signal lines.

The operation of the tristate buffer of the invention will be described. Reference is made to FIG. 9 which is a timing chart of the case of executing the opposing common inverse drive by the gate signal line drive circuit constituted by using the tristate buffers of the invention. In FIG. 9, G-CS, G-PR and G-SE are those having timings of the gate signal line of the first stage. When the opposing common potential is on the + side (901), Lo is input to G-CS (902) so that the gate line assumes the potential $VDD_2$ (903). Further, when a gate selection pulse G-SE is input (904), a pulse $VDD_1$ is output (905). Hi is input to the G-CS within the fly-back period (906) just before the opposing common potential is shifted toward the − side, and a gate line potential is dropped down to $VDD_3$ (907). Even after G-CS has assumed Low, the gate signal line potential is fixed to $VDD_3$ due to the holding capacity possessed by the gate signal line until there is input a signal for shifting to a next potential. Then, the gate line potential is once lifted up to $VDD_2$ (909) by an inverted pulse G-PR (908) of the gate selection pulse of the (m−1)-th stage and, then, the gate selection pulse G-SE of the m-th stage is input (910) to thereby output a pulse having the potential $VDD_1$ (911).

Figure 10:
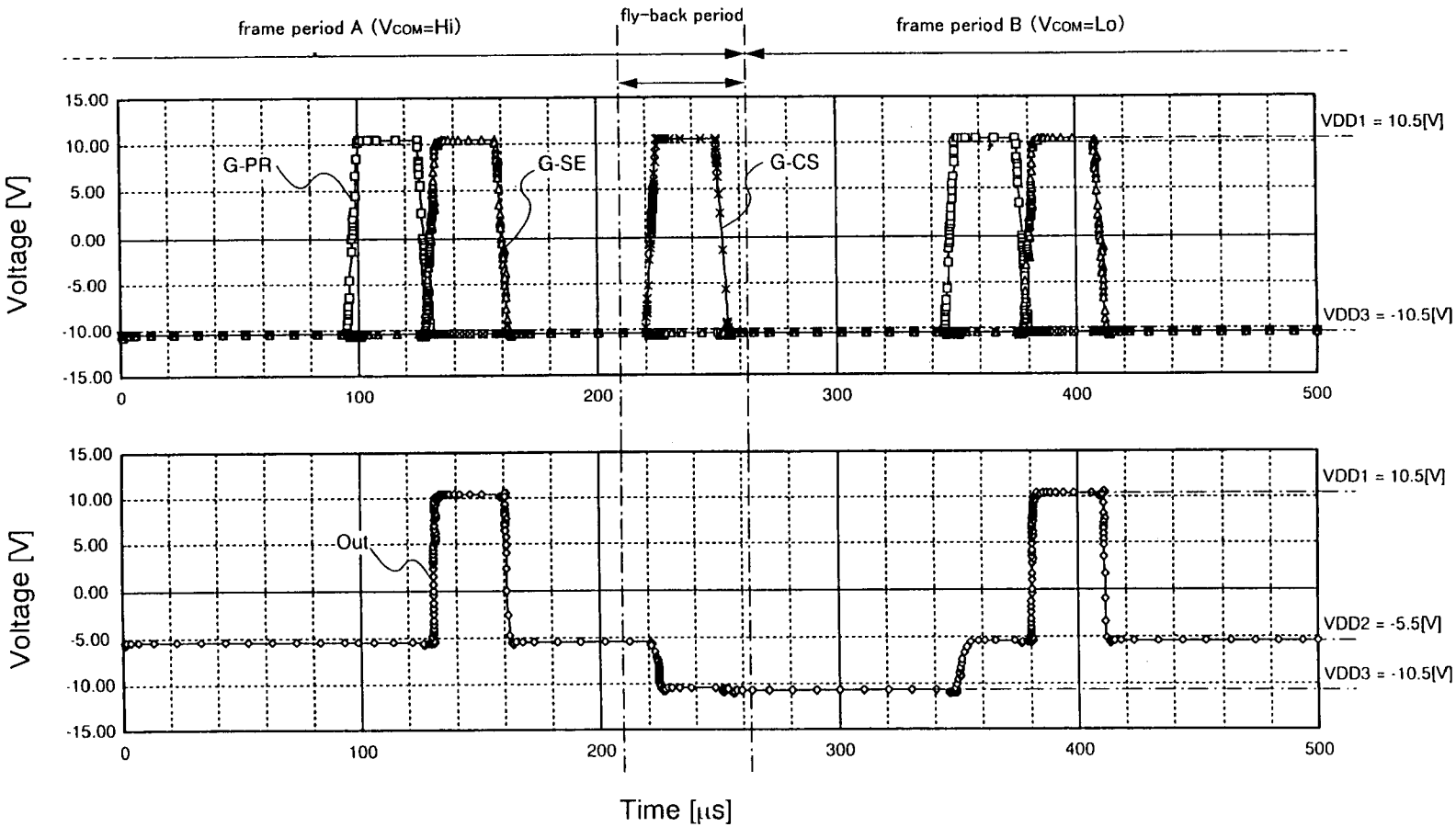
FIG. 10 is a diagram illustrating the results of simulation of a circuit using the tristate buffer of the embodiment 1.

FIG. 10 illustrates the results of simulation of when a horizontal period is set to be about 34 [μs] in the display device of VGA by using the tristate buffers of the embodiment shown in FIG. 2 at a frame frequency of 60 [Hz]. Here, however, in order to compare the consecutive two frames, the time is slightly shortened in a given frame period from when a gate signal line selection pulse is output at a given stage until when a gate signal line selection pulse is input in the next frame period in the same stage. The three potentials are $VDD_1$=10.5 [V], $VDD_2$=−5.5 [V] and $VDD_3$=−10.5 [V].

First, in a frame period in which $V_{COM}$ is Hi, the Lo potential of the gate signal line is $VDD_2$=−5.5 [V]. Even when G-PR is input, there takes place no change. Then, as G-SE is input, a pulse of a Hi potential =$VDD_1$=10.5 [V] is output to the gate signal line. When a frame period A in which $V_{COM}$ is Hi shifts to a frame period B in which $V_{COM}$ is Lo, G-CS is input in the preceding fly-back period, and the gate signal line assumes a potential $VDD_3$==10.5 [V]. Then, when G-PR is input, the potential of the gate signal line is raised to $VDD_2$=−5.5 [V]. Then, as G-SE is input immediately thereafter, a pulse of $VDD_1$=10.5 [V] is output to the gate signal line.

Embodiment 2

Figure 11:
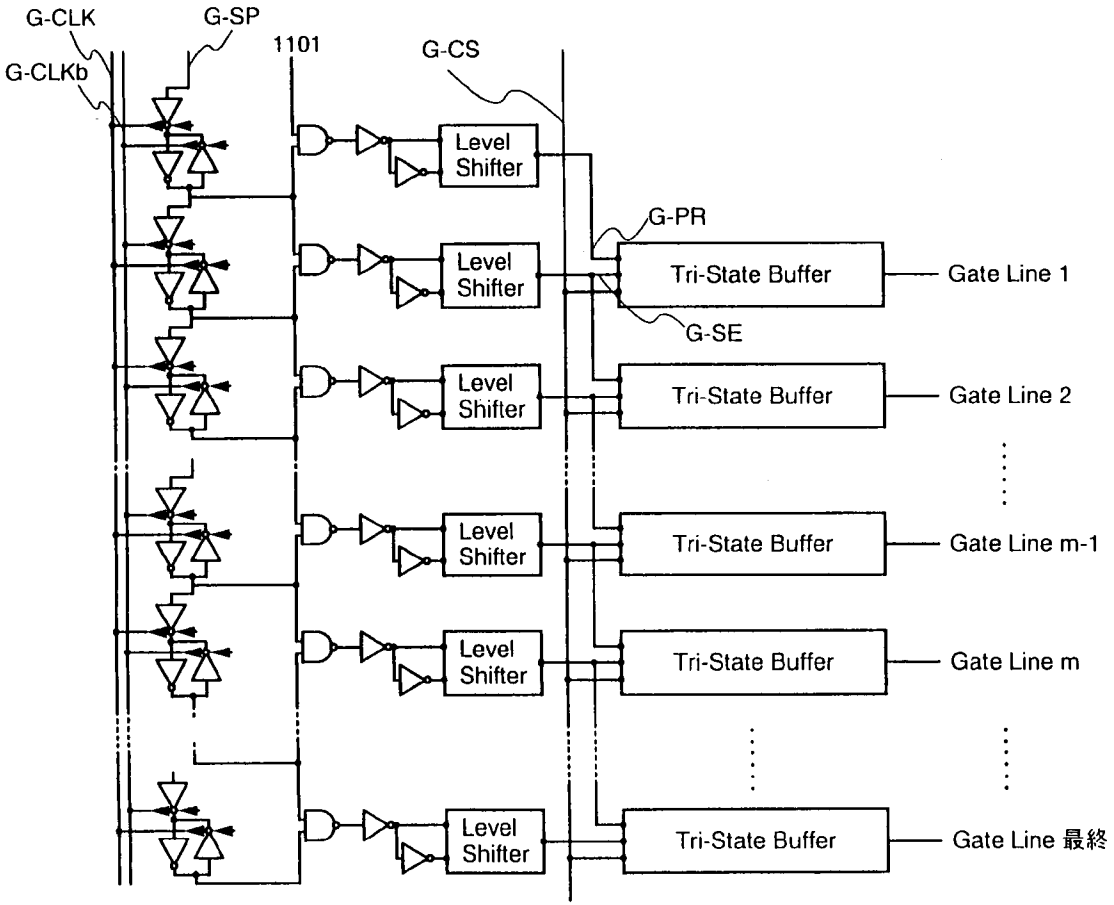
FIG. 11 is a diagram of a gate signal line drive circuit in the active matrix-type semiconductor display device according to an embodiment 2.

The G-PR input to the tristate buffer in the first stage of the gate signal line drive circuit may further be obtained by, as shown in FIG. 11, arranging a shift register circuit, a NAND circuit and an inverter circuit just before the first stage of the gate signal line drive circuit, and by inputting a suitable pulse formed by using a start pulse and a clock signal to one input signal line 1101 connected to the NAND circuit, or a signal may be input to the signal line 1101 from an external unit.

Embodiment 3

Figure 12:
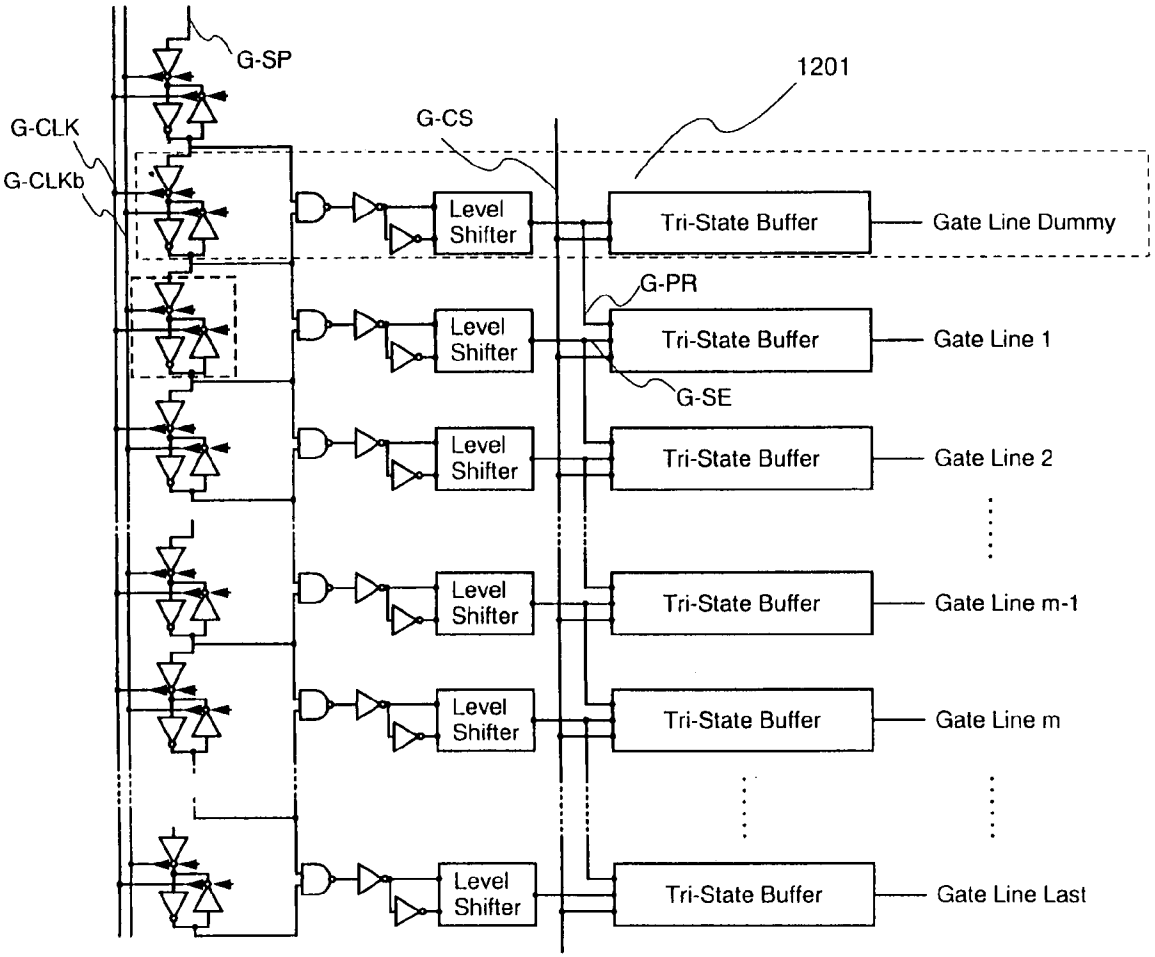
FIG. 12 is a diagram of the gate signal line drive circuit in the active matrix-type semiconductor display device according to an embodiment 3.

G-PR input to the tristate buffer of the first stage of the gate signal line drive circuit may further be obtained by, as shown in FIG. 12, arranging a dummy stage 1201 just before the first stage of the gate signal line drive circuit.

Embodiment 4

This embodiment deals with a method of fabricating the active matrix-type liquid crystal display device explained in Example 1 by arranging, on the same substrate, pixel TFTs which are switching elements in the pixel unit and TFTs of drive circuits (source signal line side drive circuit, gate signal line side drive circuit, etc) around the pixel unit in accordance with the steps. Here, however, to simplify the explanation, a CMOS circuit which is a basic constituent circuit is diagramed as a drive circuit unit, and n-channel TFT is diagramed as a pixel TFT unit.

Reference is made to FIG. 16. A substrate 5001 is an alkali-free glass substrate as represented by, for example, a 1737 glass substrate of Coning Co. An underlying film 5002 is formed, by plasma CVD method or sputtering method. on the surface of the substrate 5001 on where TFTs are to be formed. The underlying film 5002 is formed as a laminated layer (not shown) of a silicon nitride film maintaining a thickness of from 25 to 100 [nm] and 50 [nm] here and a silicon oxide film maintaining a thickness of from 50 to 300 [nm] and 150 [nm] here. The underlying film 5002 may be formed of a silicon nitride film only or a silicon oxynitride film only.

Next, an amorphous silicon film is formed maintaining a thickness of 50 [nm] on the underlying film 5002 by the plasma CVD method. It is desired that the amorphous silicon film is subjected to the dehydrogenation treatment by being heated at 400 to 550 [° C.] for several hours though it may vary depending upon the content of hydrogen to decrease the hydrogen content to be not larger than 5 [atomic %] so as to be crystallized. Further, the amorphous silicon film may be formed by any other method such as sputtering or vaporization, and it is desired that the content of impurity elements such as oxygen, nitrogen and the like contained in the film is decreased to a sufficient degree.

Here, both the underlying film and the amorphous silicon film are formed by the plasma CVD method. In this case, the underlying film and the amorphous silicon film may be continuously formed in vacuum. Owing to the continuous formation, the surface of the underlying film that has been formed is prevented from being exposed to the open air and is not contaminated, contributing to decreasing dispersion in the characteristics of the TFTs that are fabricated.

The amorphous silicon film may be crystallized relying upon the known laser crystallization technology or thermal crystallization technology. In this embodiment, a pulse oscillation-type KrF excimer laser beam is linearly focused and is projected onto the amorphous silicon film to form a crystalline silicon film.

In this embodiment, the semiconductor layer is formed by crystallizing the amorphous silicon film by using a laser beam or heat. It is, however, also allowable to use a fine crystalline silicon film or to directly grow the crystalline silicon film.

The thus formed crystalline silicon film is patterned to form island-like semiconductor layers 5003, 5004 and 5005.

Next, a gate-insulating film 5006 comprising chiefly silicon oxide or silicon nitride is formed to cover the island-like semiconductor layers 5003, 5004 and 5005. The gate-insulating film 5006 may be a silicon oxynitride film formed by the plasma CVD method using $N_2O$ and $SiH_4$ as starting materials maintaining a thickness of from 10 to 200 [nm] and, preferably, from 50 to 150 [nm]. Here, the thickness is maintained at 100 [nm].

On the surface of the gate-insulating film 5006 are formed a first electrically conducting film 5007 that serves as a first gate electrode and a second electrically conducting film 5008 that serves as a second gate electrode. The first electrically conducting film 5007 may be formed of a semiconductor film of an element selected from Si and Ge, or may be formed of these elements as chief components. The first electrically conducting film 5007 must have a thickness of from 5 to 50 [nm] and, preferably, from 10 to 30 [nm]. In this embodiment, the Si film is formed maintaining a thickness of 20 [nm].

An impurity element that imparts n-type or p-type of electric conduction may be added to the semiconductor film that is used as the first electrically conducting film. The semiconductor film may be formed according to a conventional method by, for example, maintaining the substrate temperature at 450 to 500 [° C.] by a reduced-pressure CVD method and introducing 250 [sccm] of disilane ($Si_2H_6$) and 300 [sccm] of helium (He). Here, an n-type semiconductor film may be formed by mixing $PH_3$ in an amount of 0.1 to 2 [%] into $Si_2H_6$.

Figure 16A:
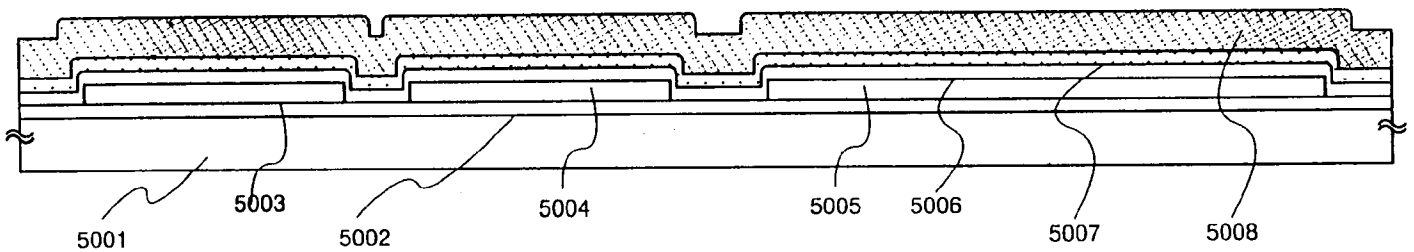
FIGS. 16A to 16C are views illustrating the steps for fabricating the active matrix-type semiconductor display device according to an embodiment 4.

The second electrically conducting film that serves as the second gate electrode may be formed of an element selected from Ti, Ta, W and Mo or may be formed of a compound of these elements as chief components. This is to lower the electric resistance of the gate electrode, and, for example, an Mo-W compound may be used. Here, the film is formed by sputtering by using Ta maintaining a thickness of from 200 to 1000 [nm] and, typically, 400 [nm](FIG. 16A).

Figure 16B:
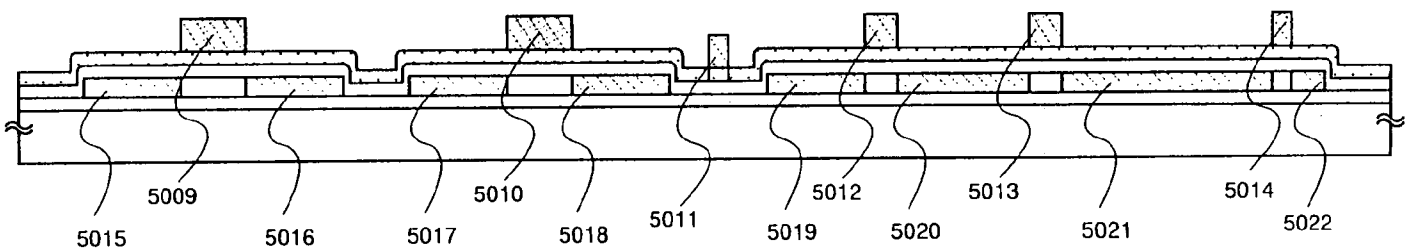

Next, a resist mask is formed by using a known patterning technology and the second electrically conducting film 5008 is etched to form the second gate electrode. The second electrically conducting film 5008 is formed of the Ta film and, hence, a dry-etching method is employed. The dry-etching is conducted by introducing 80 [sccm] of $Cl_2$ under 100 [mTorr] using a high-frequency electric power of 500 [W]. Referring next to FIG. 16B), second gate electrodes 5009, 5010 5012, 5013 and a wiring 5011 are formed. As for the length of the second gate electrode in the direction of channel length, the second gate electrodes 5009 and 5010 forming the CMOS circuit of this embodiment have a length of 3 [μm]. Besides, the pixel matrix circuit has a multi-gate structure in which the second gate electrodes 5012 and 1013 have a length of 2 [μm], respectively.

When the residue is confirmed after the etching, the residue may be removed by washing with a solution such as SPX washing solution or EKC.

The second electrically conducting film 5008 may be removed by wet-etching. For example, the film of Ta can be easily removed by using an etching solution of hydrofluoric acid.

Further, a holding capacity is provided on the drain side of the n-channel TFT that constitutes the pixel matrix circuit. Here, a wiring electrode 5014 of the holding capacity is formed of the same material as the second electrically conducting film.

Next, a first impurity element is added to impart n-type. This is to form a second impurity region. In this embodiment, this is done by the ion-doping method using phosphine ($PH_3$). In this step, the acceleration voltage must be set to be as high as 80 [keV] to add phosphorus (P) into the underlying semiconductor layer through the gate-insulating film 5006 and the first electrically conducting film 5007. It is desired that the phosphorus concentration in the semiconductor layer is in a range of from $1\times10^{16}$ to $1\times10^{19}$ [atoms/$cm^3$] and is, here, $1\times10^{18}$ [atoms/$cm^3$]In the semiconductor layer are thus formed regions 5015, 5016, 5017, 5018, 5019, 5020, 5021 and 5022 to which phosphorus is added (FIG. 16B).

Here, phosphorus is added even into those regions of the first electrically conducting film 5007 that are not overlapped on the second gate electrodes 5009, 5010, 5012. 5013, wiring 5011 and holding capacity wiring 5014. Though there is no particular limitation on the concentration of phosphorus in these regions, phosphorus is effective in lowering the resistivity of the first electrically conducting film.

Next, the region for forming the n-channel TFTs is covered with resist masks 5023, 5024, and the first electrically conducting film 5007 is partly removed. In this embodiment, this is done by dry-etching. The first electrically conducting film 5007 is formed of Si, and the dry-etching is conducted by introducing 50 [sccm] of $CF_4$ and 45 [sccm] of $O_2$ under 50 [mTorr] using a high-frequency electric power of 200 [W]. As a result, those portions of the first electrically conducting film 5025 covered with the resist masks 5023, 5024 and with the second gate conducting film, remain.

Figure 16C:
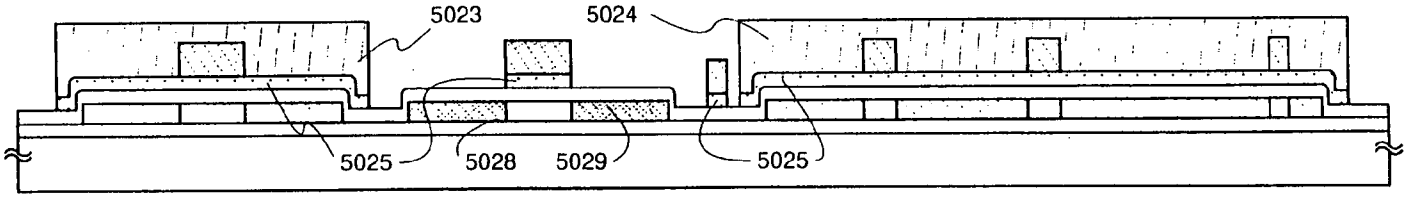

A third impurity element that imparts p-type is added to the region where the p-channel TFTs are to be formed. Here, diborane ($B_2H_6$) is added by the ion-doping method. The acceleration voltage is selected to be 80 [keV] to add boron at a concentration of $2\times10^{20}$ [atoms/$cm^3$]. There are thus formed third impurity regions 5028 and 5029 into where boron is added at a high concentration (FIG. 16C).

Reference is made to FIG. 17. After the third impurity element is added, the resist masks 5023 and 5024 are completely removed, and there are formed resist masks 5030, 5031, 5032, 5033, 5034 and 5035 again. By using the resist masks 5030, 5033, 5034 and 5035, the first electrically conducting film is etched, and there are newly formed first electrically conducting films 5036, 5037, 5038 and 5039.

Figure 17A:
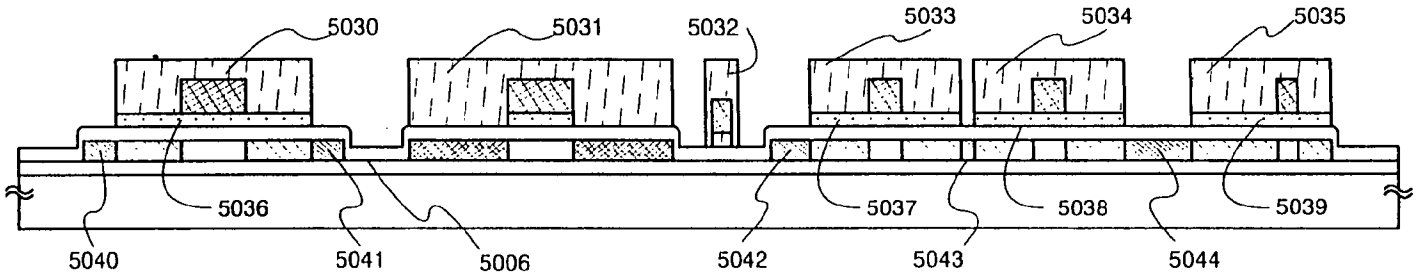
FIGS. 17A to 17C are views illustrating the steps for fabricating the active matrix-type semiconductor display device according to the embodiment 4.

Among the resist masks formed in FIG. 17A, the resist mask 5030 used for forming the n-type TFT has a length of 9 [μm] in the direction of channel length, and the resist masks 5033 and 5034 have a length of 7 [μm].

Then, a second impurity element is added to impart n-type. In this embodiment, phosphine ($PH_3$) is added by the ion-doping method. In this step, too, the acceleration voltage is set to be as high as 80 [keV] to add phosphorus to the underlying semiconductor layer through the gate-insulating film 5006. There are thus formed regions 5040, 5041, 5042, 5043 and 5044 to which phosphorus is added. It is desired that the phosphorus concentration in these regions is higher than that of the step of adding the first impurity element for imparting n-type, and is from $1\times10^{19}$ to $1\times10^{21}$ [atoms/cm$^3$] and is, here, $1\times10^{20}$ [atoms/cm$^3$] (FIG. 17A).

Figure 17B:
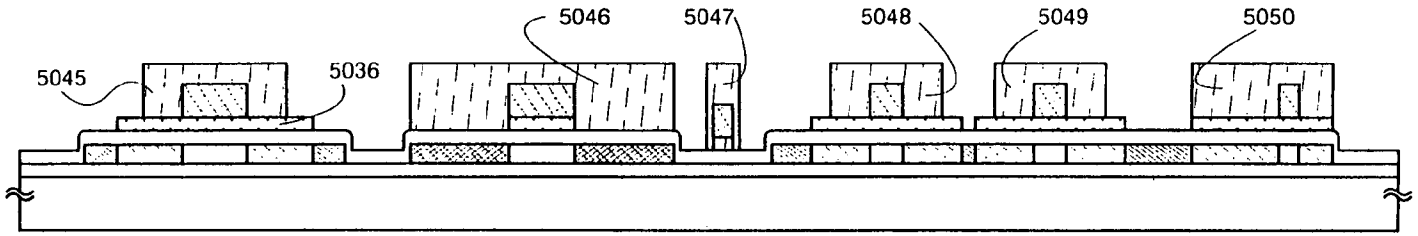

Then, the resist masks 5030, 5031, 5032, 5033, 5034 and 5035 are removed, and there are newly formed resist masks 5045, 5046, 5047, 5048, 5049 and 5050, and, then, the first electrically conducting film is etched. In this step, the lengths of the resist masks 5045, 5048 and 5049 formed for the n-channel TFTs in the direction of channel length, are important from the standpoint of determining the structure of the TFTs. The resist masks 5045, 5048 and 5049) are formed for partly removing the first electrically conducting films 5036, 5037 and 5038. Relying upon the lengths of the resist masks, it is allowed to freely determine, within certain ranges, the region where the second impurity region is overlapped on the first electrically conducting film and the region where the second impurity region is not overlapped on the first electrically conducting film (FIG. 17B).

Figure 17C:
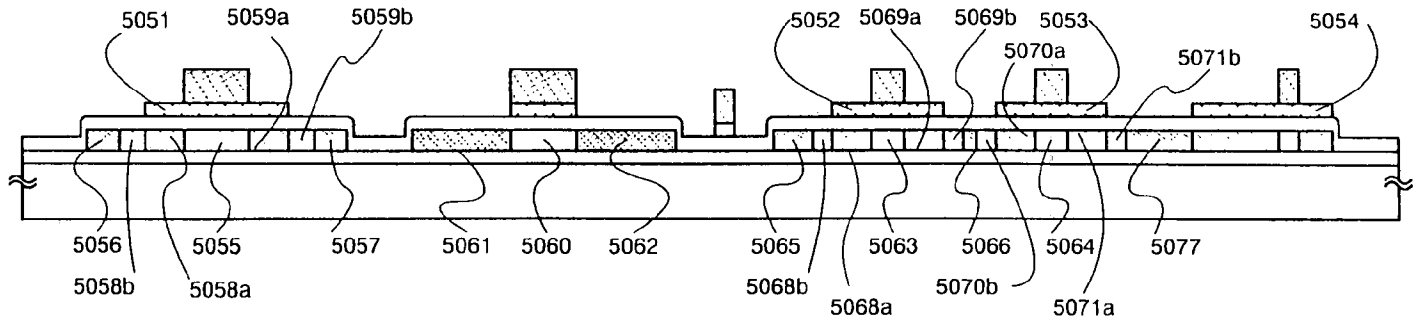

Referring next to FIG. 17C, there are formed first gate electrodes 5051, 5052 and 5053. Here, the first gate electrode 5051 has a length of 6 [μm] in the direction of channel length, and the first gate electrodes 5052 and 5053 have a length of 4 [μm] in the direction of channel length.

Further, an electrode 5054 of the holding capacity is formed in the pixel matrix circuit.

Through the above steps, there are formed a channel-forming region 5055, first impurity regions 5056 and 5057, and second impurity regions 5058 and 5059 for the n-channel TFTs of the CMOS circuit. Here, the second impurity region is so formed that the regions (GOLD regions) 5058*a* and 5059*a* overlapped on the gate electrode have a length of 1.5 [μm] and the regions (LDD regions) 5058*b* and 5059*b* that are not overlapped on the gate electrode have a length of 1.5 [μm], respectively. The first impurity region 5056 serves as the source region and the first impurity region 5057 serves as the drain region.

For the p-channel TFT, there are similarly formed a gate electrode of a clad structure, a channel-forming region 5060 and third impurity regions 5061, 5062. The third impurity region 5062 serves as the source region and the third impurity region 5061 serves as the drain region.

The n-channel TFT in the pixel matrix circuit is a multi-gate TFT, and for which are formed channel-forming regions 5063, 5064, first impurity regions 5065, 5066 and 5067, and second impurity regions 5068, 5069, 5070 and 5071. Here, the second impurity region includes regions 5068*a*, 5069*a*, 5070*a* and 5071*a* that are overlapped on the gate electrode and regions 5068*b*, 5069*b*, 5070*b* and 5071*b* that are not overlapped on the gate electrode (FIG. 17C).

Figure 18:
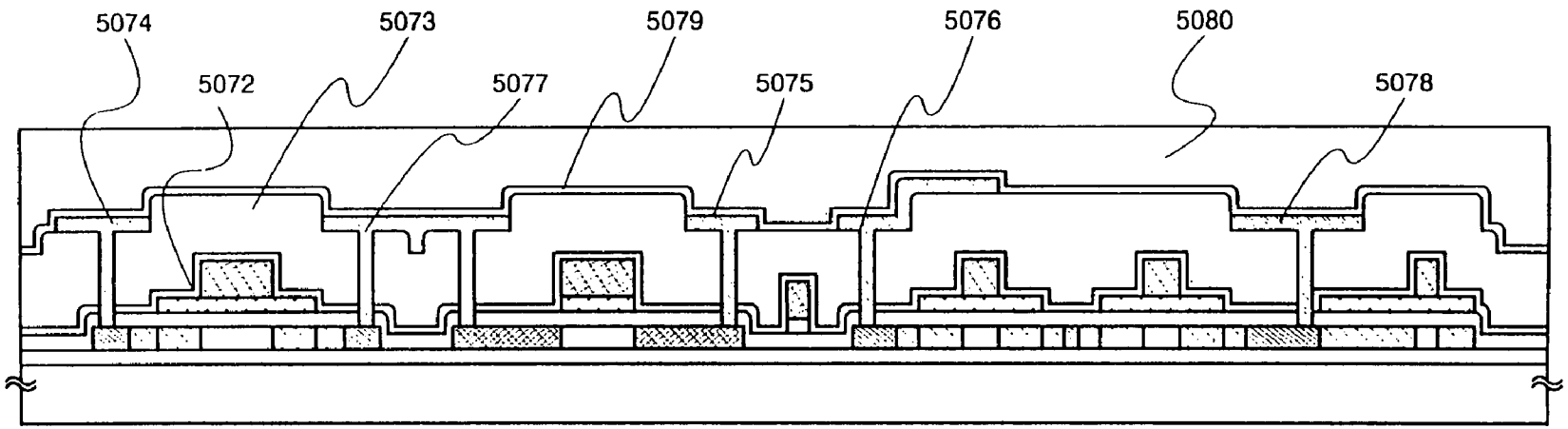
FIG. 18 is a view illustrating the steps for fabricating the active matrix-type semiconductor display device according to the embodiment 4.

Reference is made to FIG. 18. A silicon nitride film 5072 and a first interlayer insulating film 5073 are formed. First, the silicon nitride film 5072 is formed maintaining a thickness of 50 [nm]. The silicon nitride film 5072 is formed by the plasma CVD method by introducing 5 [sccm] of $SiH_4$, 40 [sccm] of $NH_3$ and 100 [sccm] of $N_2$ under 0.7 [Torr] using a high-frequency electric power of 300 [W]. Then, as the first interlayer insulating film 5073, there is formed a silicon oxide film maintaining a thickness of 950 [nm] by introducing 500 [sccm] of TEOS and 50 [sccm] of $O_2$ under 1 [Torr] using a high-frequency electric power of 200 [W].

Heat treatment is then effected. Heat treatment is necessary for activating the impurity element that is added at a given concentration for imparting n-type or p-type. This step may be executed by a heat-annealing method using an electrically heated furnace, by a laser-annealing method using the above excimer laser or by a rapid thermal annealing method (RTA method) using a halogen lamp. In this embodiment, the activation is effected relying on the heat-annealing method. The heat treatment is carried out in a nitrogen atmosphere at 300 to 700 [° C.] and, preferably, at 350 to 550 [° C.] and, in this embodiment, at 450 [° C.] for 2 hours.

The silicon nitride film 5072 and the first interlayer insulating film 5073 are then patterned to form contact holes that reach the source regions and drain regions of the respective TFTs. Thereafter, source electrodes 5074, 5075, 5076 and drain electrodes 5077 and 5078 are formed. In this embodiment, the electrodes are formed in a three-layer structure (not shown) by continuously forming, by sputtering, a Ti film maintaining a thickness of 100 [nm], an aluminum film containing Ti maintaining a thickness of 300 [nm] and a Ti film maintaining a thickness of 150 [nm].

Then, a passivation film 5079 is formed to cover the source electrodes 5074, 5075, 5076, the drain electrodes 5077, 5078, and the first interlayer insulating film 5073. The passivation film 5079 is formed of a silicon nitride film maintaining a thickness of 50 [nm]. Then, a second interlayer insulating film 5080 of an organic resin is formed maintaining a thickness of about 1000 [nm]. As the organic resin film, there can be used polyimide, acrylic resin, polyimideamide or the like. Use of an organic resin film offers such advantages as easy film-forming method, decreased parasitic capacity due to a low specific inductivity, and excellent flatness. It is also allowable to use an organic resin film other than those described above. In this embodiment, a polyimide of the type that is thermally polymerized is applied onto the substrate and is fired at 300 [° C.].

Thus, an active matrix substrate is obtained having a CMOS circuit and a pixel matrix circuit formed on the substrate 5001 as shown in FIG. 18. Further, a holding capacity is also formed on the drain side of the n-channel TFT of the pixel matrix circuit.

Figure 19:
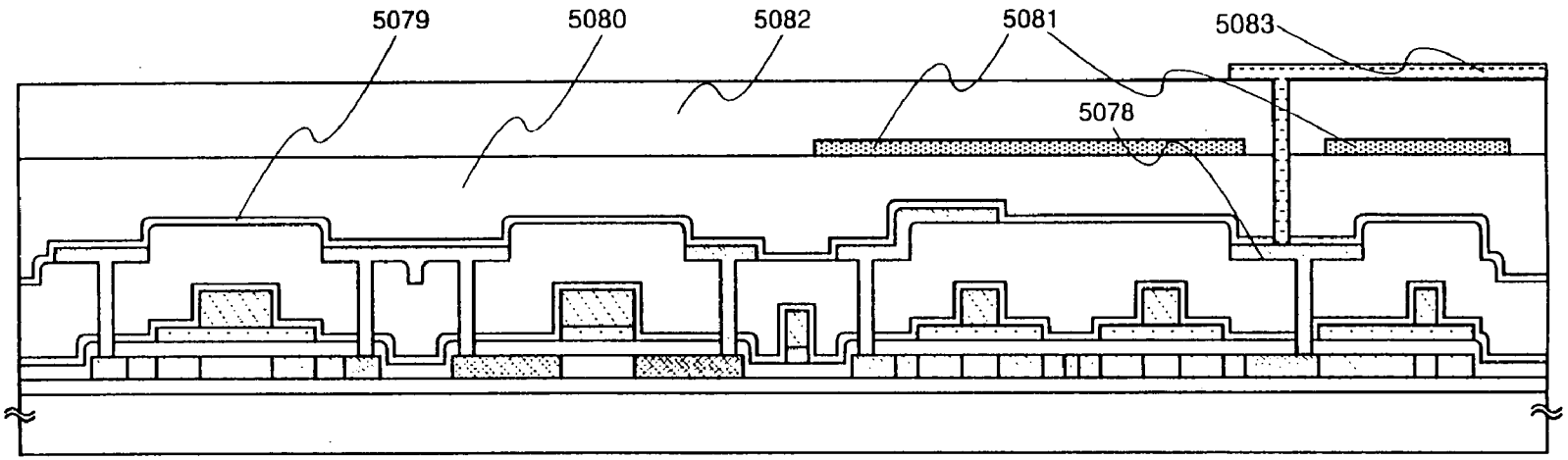
FIG. 19 is a view illustrating the steps for fabricating the active matrix-type semiconductor display device according to the embodiment 4.

Referring to FIG. 19, a light-shielding film 5081 and a third interlayer insulating film 5082 are formed on the active matrix substrate of a state shown in FIG. 18. The light-shielding film 5081 may be an organic resin film containing a pigment or a metal film such as of Ti or Cr. Further, the third interlayer insulating film 5082 is formed of an organic resin film such as of polyimide. A contact hole is formed in the third interlayer insulating film 5082, in the second interlayer insulating film 5080 and in the passivation film 5079 so as to reach the drain electrode 5078, thereby to form a pixel electrode 5083. The pixel electrode 5083 may be a transparent electrically conducting film when the liquid crystal display device is of the transmission type and may be a metal film when the liquid crystal display device is of the reflection type. Here, in order to realize the liquid crystal display device of the transmission type, an indium-tin oxide (ITO) film is formed by sputtering maintaining a thickness of 100 [nm] to thereby form the pixel electrode 5083.

Figure 20:
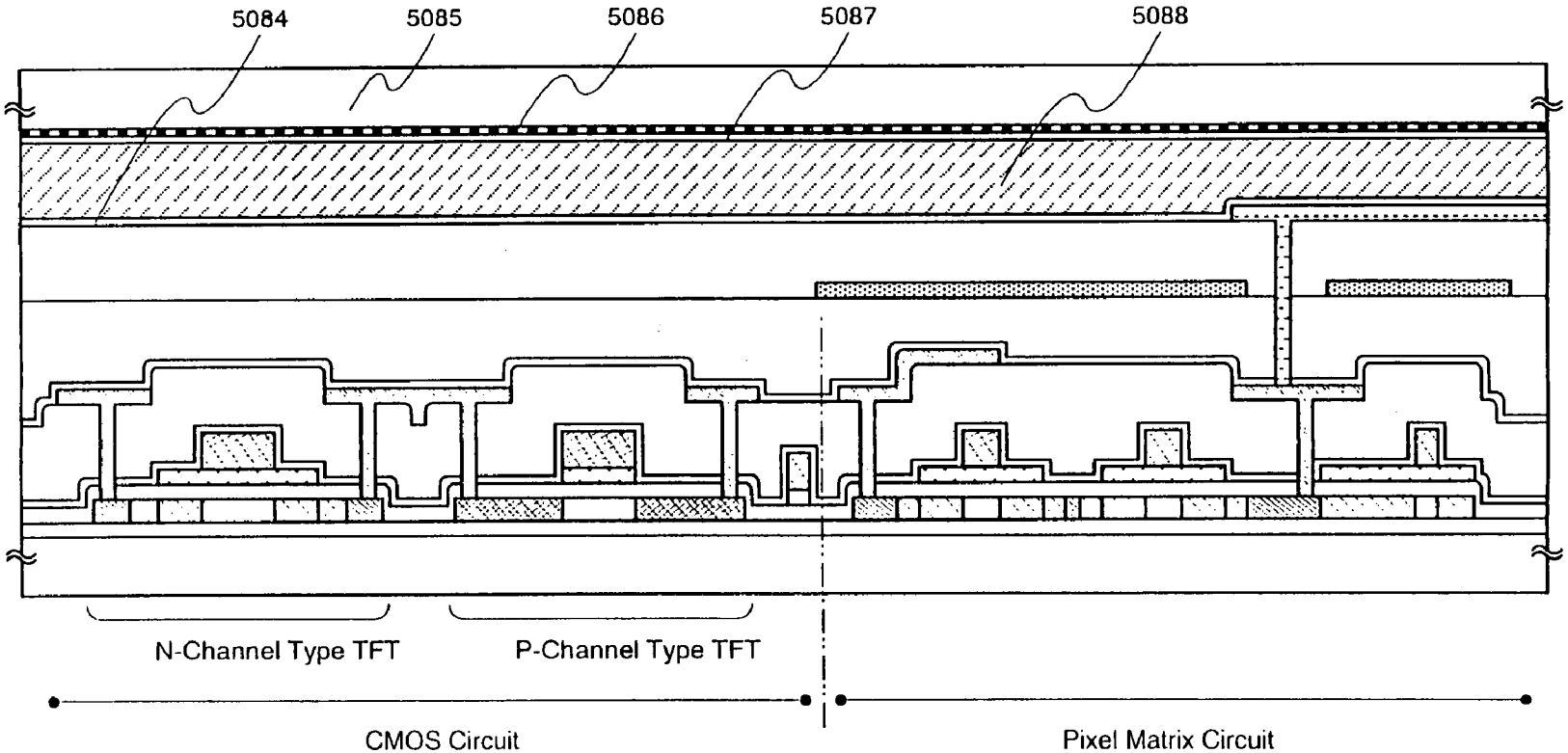
FIG. 20 is a view illustrating the steps for fabricating the active matrix-type semiconductor display device according to the embodiment 4.

Referring next to FIG. 20, an orientation film 5084 is formed on the third interlayer insulating film 5082 and on the pixel electrode 5083. Usually, a polyimide resin is in many cases used as the orientation film for the liquid crystal display element. A transparent electrically conducting film 5086 and an oriented film 5087 are formed on a substrate 5085 of the opposing side. The orientation film after formed is rubbed so that the liquid crystal molecules are orientated in parallel maintaining a predetermined pretilted angle.

Through the above step, the opposing substrate is stuck to the active matrix substrate in which the pixel matrix circuit and the CMOS circuit are formed, via a sealing member and a spacer (both of them are not shown) through known steps of assembling the cells. Thereafter, a liquid crystal material 5088 is poured into between the two substrates and is completely sealed with a sealing agent (not shown). Thus, the active matrix-type liquid crystal display device shown in FIG. 20 is completed.

Embodiment 5

This embodiment deals with the removal of portions of the first gate electrode by another method after the state shown in FIG. 17A is obtained through the same steps as those of the embodiment 4.

Figure 21:
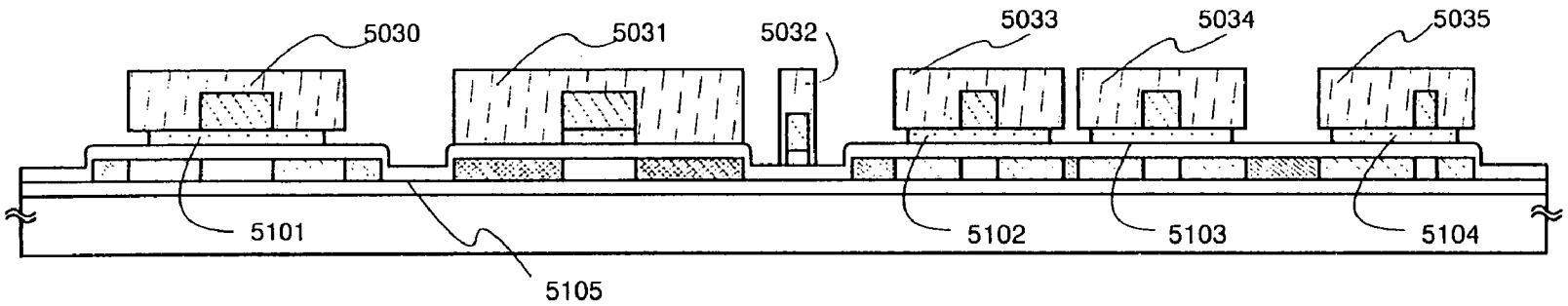
FIG. 21 is a view illustrating the steps for fabricating the active matrix-type semiconductor display device according to an embodiment 5.

Reference is made to FIG. 21. The first gate conducting films 5101, 5102, 5103 and 5104 are partly removed as shown in FIG. 21 by etching by using the resist masks 5030, 5031, 5032, 5033, 5034, and 5035 formed in FIG. 17A.

When the first gate electrode is a silicon film, the dry-etching is effected by introducing 40 [sccm] of $SF_6$ and 10 [sccm] of $O_2$ under 100 [mTorr] using a high-frequency electric power of 200 [W].

Since the selection ratio to the underlying gate-insulating film is sufficiently high, the gate-insulating film 5105 is not almost etched under the above dry-etching condition.

Up to this step, the resist mask 5030 is formed maintaining a length of 9 [μm], and the resist masks 5033 and 5034 are formed maintaining a length of 7 [μm] in the direction of channel length of TFTs. The first electrically conducting films are each removed by 1.5 [μm] by dry-etching to thereby form first gate electrodes 5101, 5102, 5103 and the electrode 5104 of the holding capacity as shown in FIG. 17.

Up to this step, the TFT portion becomes the same as that of the embodiment 4 shown in FIG. 17C. The subsequent steps may be executed in the same manner as those of the embodiment 4, and the active matrix substrate shown in FIG. 19 is completed through the steps of forming electrodes, silicon nitride film, first to third interlayer films, passivation film and light-shielding film.

Embodiment 6

This embodiment describes the formation of a crystalline semiconductor film used as the semiconductor layer in the embodiment 4 relying upon the thermal crystallization method by using a catalytic element. When a catalytic element is to be used, it is desired to employ technology disclosed in Japanese Patent Laid-Open Nos. 130652/1995 and 78329/1996.

Figure 22A:
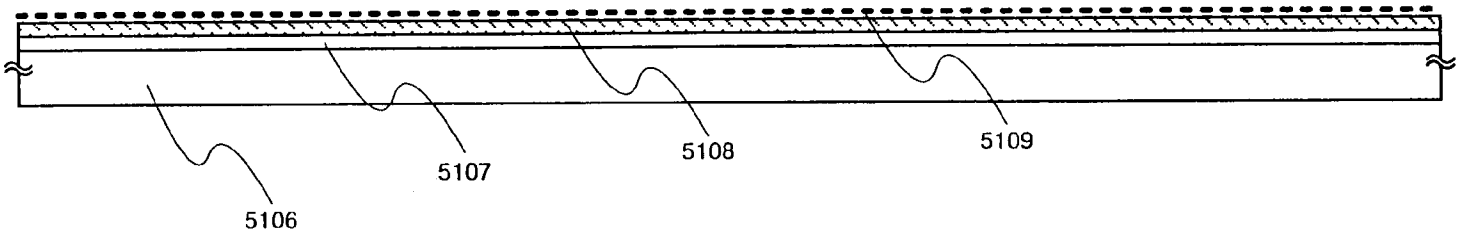
FIGS. 22A and 22B are views illustrating the steps for fabricating the active matrix-type semiconductor display device according to an embodiment 6.

FIG. 22 shows the case where the technology disclosed in Japanese Patent Laid-Open No. 130652/1995 is applied to this invention. First, a silicon oxide film 5107 is formed on a substrate 5106, and an amorphous silicon film 5108 is formed thereon. Then, a solution of nickel acetate containing 10 [ppm] of nickel on the basis of weight is applied to form a nickel-containing layer 5109 (FIG. 22A).

Figure 22B:
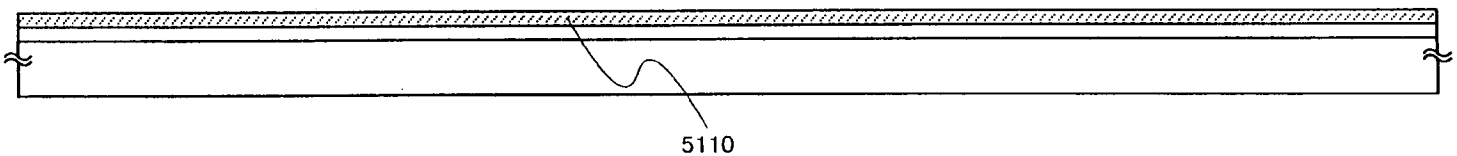

Next, after the dehydrogenation step at 500 [° C.] for one hour, the heat treatment is conducted at 500 to 650 [° C.] for 4 to 12 hours, for example, at 550 [° C.] for 8 hours to form a crystalline silicon film 5110. The thus obtained crystalline silicon film 5110 exhibits very excellent crystallinity (FIG. 22B).

Further, technology disclosed in Japanese Patent Laid-Open No. 78329/1996 enables the amorphous semiconductor film to be selectively crystallized by the selective addition of a catalytic element. An example of when the above technology is applied to this invention will now be described with reference to FIG. 23.

A silicon oxide film 5112 is formed on a substrate 5111, followed by the continuous formation of an amorphous silicon film 5113 and a silicon oxide film 5114 thereon. In this embodiment, the silicon oxide film 5114 has a thickness of 150 [nm].

Figure 23A:
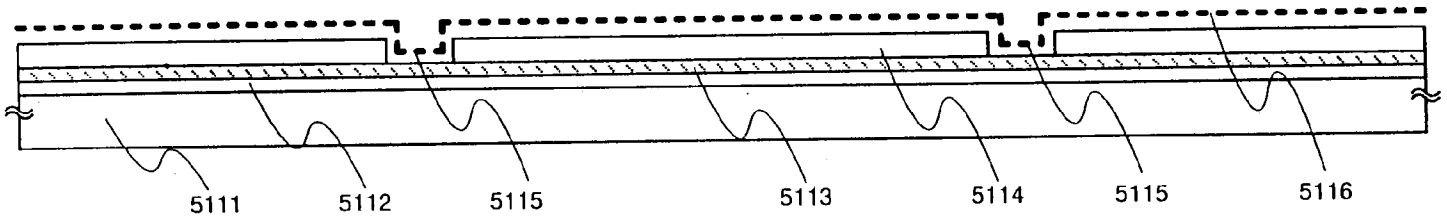
FIGS. 23A to 23C are views illustrating the steps for fabricating the active matrix-type semiconductor display device according to the embodiment 6.
Figure 23B:
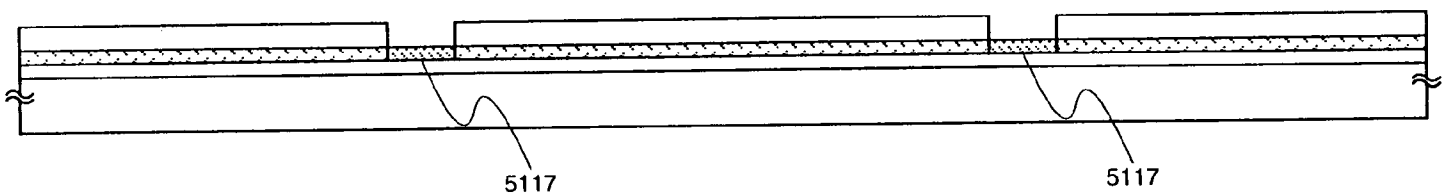

Next, the silicon oxide film 5114 is patterned, holes 5115 are selectively formed and, then, a solution of nickel acetate containing 10 [ppm] of nickel on the basis of weight is applied. Thus, there is formed a nickel-containing layer 5116 which comes in contact with the amorphous silicon film 5112 in the bottom only of the openings 5115 (FIG. 23A).

Figure 23C:
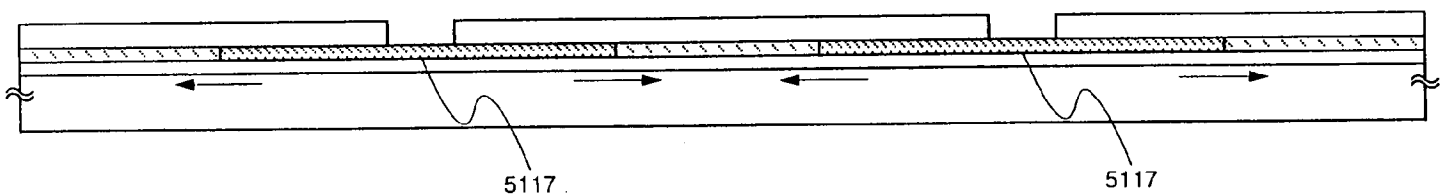

Next, the heat treatment is effected at 500 to 650 [° C.] for 4 to 24 hours, for example, at 570 [° C.] for 14 hours to form a crystalline silicon film 5117. In the step of crystallization, a portion of the amorphous silicon film with which nickel comes in contact is crystallized first (FIG. 23B), and the crystallization proceeds sideways therefrom (FIG. 23C). The thus formed crystalline silicon film 5117 comprises an aggregate of rod-like or needle-like crystals which are oriented since every crystal is growing having a particular directivity if viewed macroscopically.

In the above technologies, there can be used, as a catalyst, such an element as germanium (Ge), iron (Fe), palladium (Pd), tin (Sn), lead (Pb), cobalt (Co), platinum (Pt), copper (Cu) or gold (Au) in addition to nickel (Ni).

There can be formed a semiconductor layer of crystalline TFTs by forming the crystalline semiconductor film (inclusive of crystalline silicon film and crystalline silicon-germanium film) relying upon the above technology, followed by patterning. The TFTs fabricated by using the crystalline semiconductor film relying upon the technology of this embodiment feature excellent properties but require a high degree of reliability. Upon employing the TFT structure of this invention, however, there can be fabricated TFTs utilizing the technology of this example to a maximum degree.

Embodiment 7

In this embodiment, a description will be made on an example in which as a method of forming the semiconductor layers used in Embodiment 4, after a crystalline semiconductor film is formed by using an amorphous semiconductor film as an initial film and by using a catalytic element, a step of removing the catalytic element from the crystalline semiconductor film is carried out. As a method thereof, this embodiment uses a technique disclosed in Japanese Patent Application Laid-open No. Hei. 10-135468 or No. Hei. 10-135469.

The technique disclosed in the application is such that a catalytic element used for crystallization of an amorphous semiconductor film is removed after crystallization by using a gettering function of phosphorus. By using the technique, it is possible to reduce the concentration of a catalytic element in a crystalline semiconductor film to about $1\times10^{17}$ atoms/cm$^3$ or less, preferably $1\times10^{16}$ atoms/cm$^3$ or less.

Figure 24A:
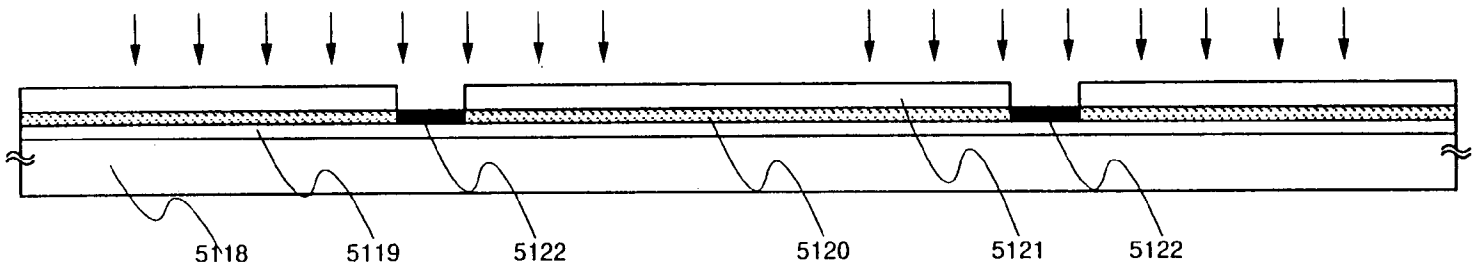
FIGS. 24A and 24B are views illustrating the steps for fabricating the active matrix-type semiconductor display device according to an embodiment 7.
Figure 24B:
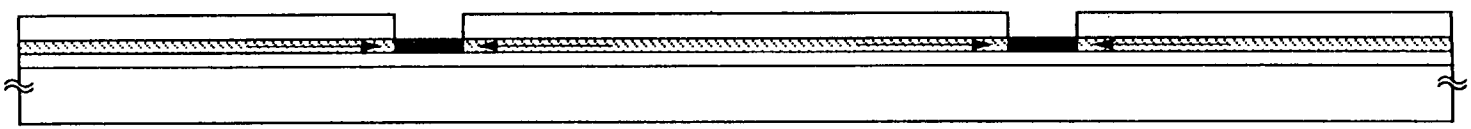

A constitution of this embodiment will be described with reference to FIG. 24. Here, an alkali-free glass substrate 5118 typified by a Corning 1737 substrate is used. FIG. 24A shows a state in which an under film 5119 and a crystalline silicon film 5120 are formed by using the crystallizing technique disclosed in Embodiment 6, and then a silicon oxide film 5121 for masking is formed to a thickness of 150 nm on the surface of the crystalline silicon film 5120, and opening portions are provided by patterning, so that regions where the crystalline silicon film was exposed are provided. Then, a step of adding phosphorus is carried out so that a region 5122 added with phosphorus is provided in the crystalline silicon film.

In this state, when a heat treatment at 550 to 800° C. for 5 to 24 hours (in this embodiment, at 600° C. for 12 hours) is carried out in a nitrogen atmosphere, the region 5122 where phosphorus was added in the crystalline silicon film functions as the gettering site, so that the catalytic elements remaining in the crystalline silicon film 5120 can be segregated into the region 5122 added with phosphorus.

By removing the silicon oxide film 5121 for masking and the region 5122 added with phosphorus through etching, it is possible to obtain a crystalline silicon film in which the concentration of the catalytic element used in the step of crystallization is reduced to $1\times10^{17}$ atoms/cm$^3$ or less. It is possible to use this crystalline silicon film without any change as the semiconductor layer of the TFT of the present invention described in Embodiment 4.

Embodiment 8

Embodiment 8 shows another embodiment to form a semiconductor layer and a gate insulating film in the fabricating process of TFTs shown in Embodiment 4. Then, the constitution of this embodiment will be explained with reference to FIG. 25.

Figure 25A:
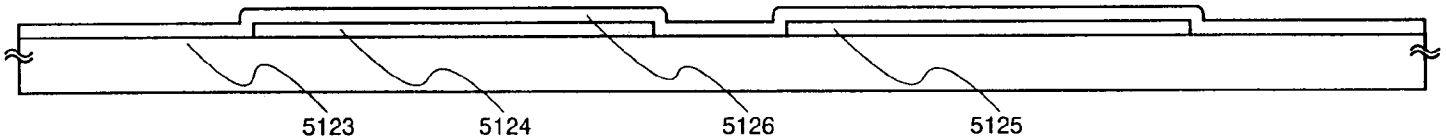
FIGS. 25A to 25C are views illustrating the steps for fabricating the active matrix-type semiconductor display device according to an embodiment 8.
Figure 25B:
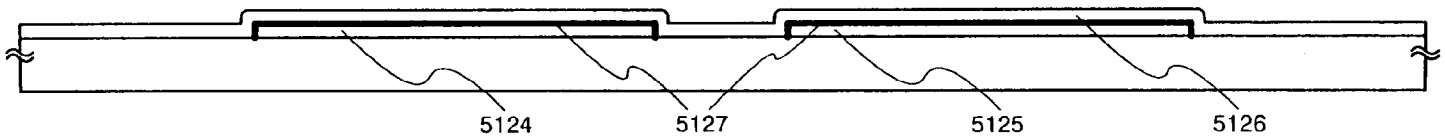

A substrate which possesses heat resistance of at least about 700 to 1100° C. is necessary here, and a quartz substrate 5123 is used. The technique shown in Embodiment 4 or Embodiment 7 is then used, forming a crystalline semiconductor film. This is patterned into island shapes for TFT semiconductor layers, forming semiconductor layers 5124 and 5125. A gate insulating film 5126 is formed from a film having silicon oxide as its principal constituent, covering the semiconductor layers 5124 and 5125. A 70 nm thick nitrated silicon oxide film is formed by plasma CVD in Embodiment 8. (FIG. 25A)

The heat treatment is then performed in an atmosphere containing a halogen (typically chlorine) and oxygen. Heat treatment is done for 30 minutes at 950° C. in Embodiment 8. Note that the process temperature may be selected in the range of 700 to 1100° C., and the process time may be chosen from 10 minutes to 8 hours.

Figure 25C:
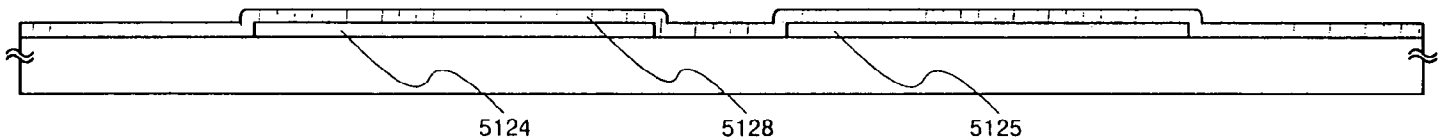

As a result, a thermal oxidation film 5127 is formed in the interface between the semiconductor layers 5124 and 5125, and the gate insulating film 5126 (FIG. 25B), thereby forming a gate insulating film 5128 combined with the gate insulating film 5126 (FIG. 25C). Further, the impurity contained in the gate insulating film 5126 and in the semiconductor layers 5124 and 5125, especially a metallic impurity element, forms a compound with the halogen and can be removed in the gas phase in this oxidation process in the halogen atmosphere.

The gate insulating film 5128 manufactured by the above processes has a high withstand voltage and the interface between the semiconductor layers 5124 and 5125 and the gate insulating film 5128 is extremely good. Subsequent processes may be performed in accordance with those of Embodiment 4 in order to obtain the TFT structure of the present invention.

Embodiment 9

In the fabrication method for forming the crystalline semiconductor film by the method described in Embodiment 6 and the active matrix substrate by the steps shown in Embodiment 4, this example represents the example where the catalytic element used for the crystallization process is removed by gettering. First, in Embodiment 4, the semiconductor layers 5003, 5004 and 5005 shown in FIG. 16(A) are the crystalline silicon films formed by using the catalytic element. Since the catalytic element used for the crystallization process remains in the semiconductor layer at this time, the gettering process is preferably carried out.

Here, the process step shown in FIG. 16(C) is as such carried out. Then, the resist masks 5023 and 5024 are removed.

Figure 26A:
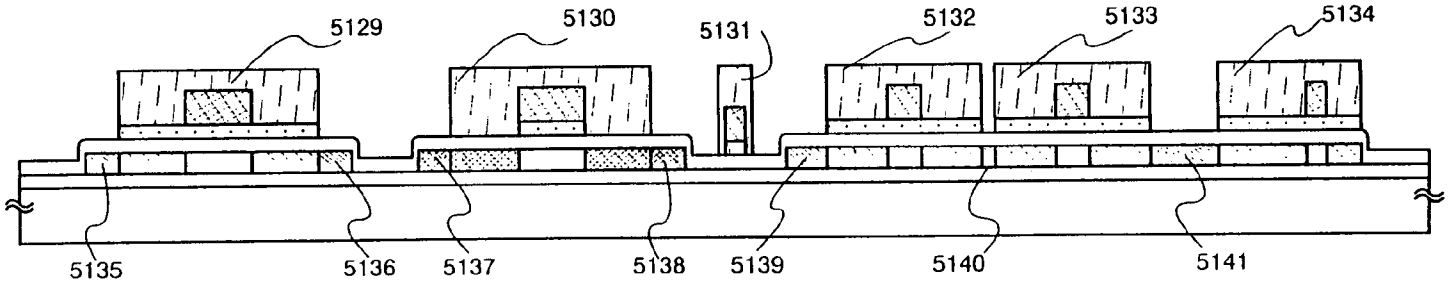
FIGS. 26A and 26B are views illustrating the steps for fabricating the active matrix-type semiconductor display device according to an embodiment 9.

Then, new resist masks 5129 to 5134 are formed as shown in FIG. 26A. Next, the step of adding the second impurity imparting n-type is performed. There are thus formed the regions 5135 to 5141 in which phosphorus is added into the semiconductor layer.

Boron as the p-type imparting impurity element has been already added to these P-doped regions 5137, 5138. The P concentration at this time is $1\times10^{19}$ to $1\times10^{21}$ atoms/cm$^3$ and is about ½ of the concentration of boron. Therefore, no influences are observed on the characteristics of the p-channel TFT.

Heat-treatment is carried out under this state at 400 to 800° C. for 1 to 24 hours, for example, at 600° C. for 12 hours, in a nitrogen atmosphere. This step can activate the n- and p-type imparting impurity elements. Furthermore, because the P-doped regions function as the gettering site, the catalytic elements remaining after the crystallization step can be segregated. As a result, the catalytic element can be removed from the channel formation region (FIG. 26(B)).

Figure 26B:
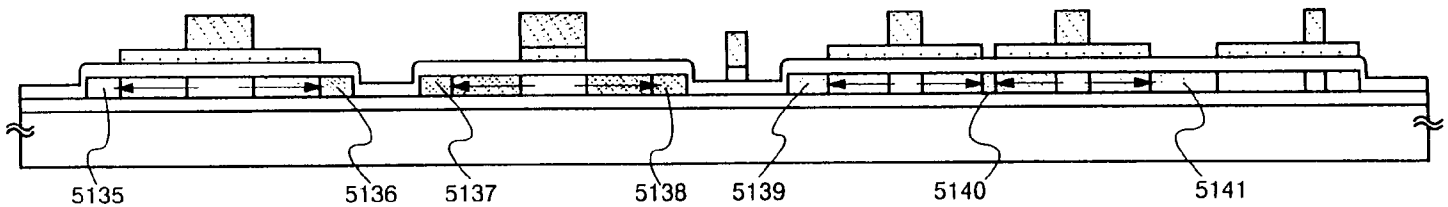

After the process step in FIG. 26(B) is completed, the subsequent steps are conducted in the same way as those in embodiment 4, and the active matrix substrate can be fabricated.

Embodiment 10

This embodiment deals with a constitution for changing over the scanning direction up and down in a drive circuit constituted by using the tristate buffer of this invention.

Figure 13:
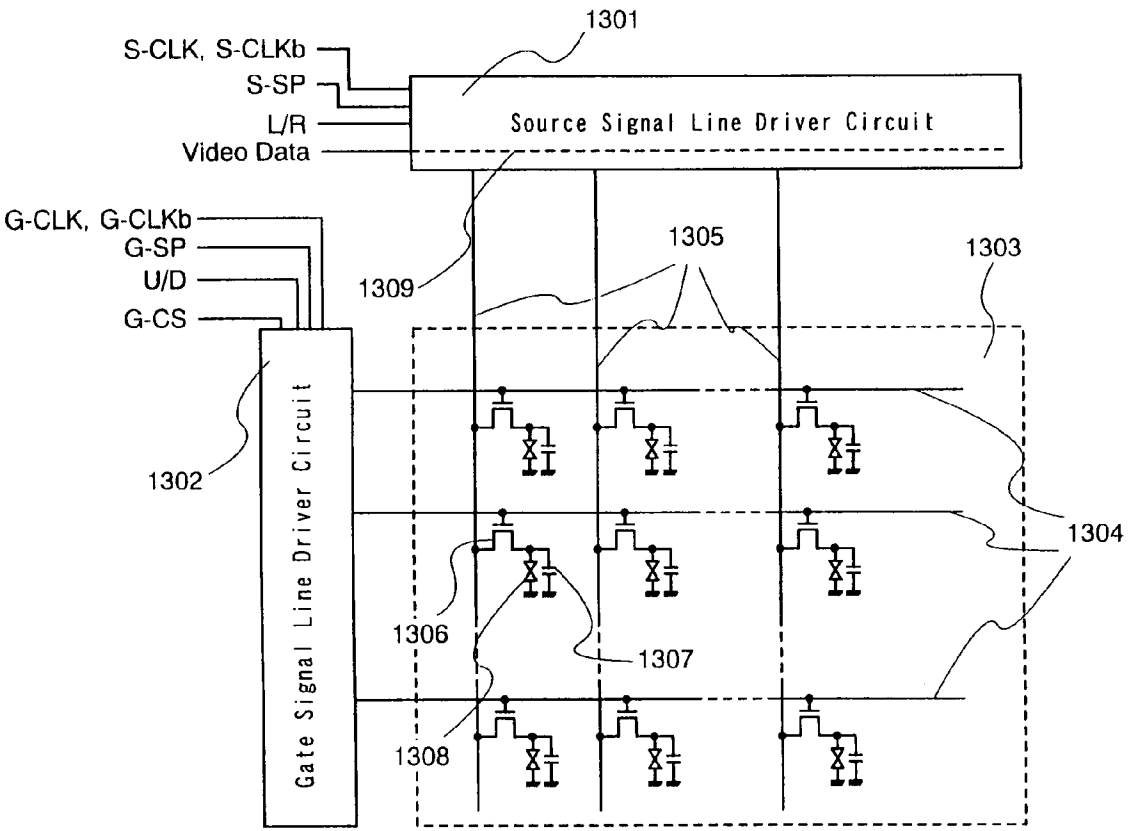
FIG. 13 is a diagram schematically illustrating the constitution of the active matrix-type semiconductor display device according to an embodiment 10.

Reference is made to FIG. 13 which is a diagram schematically illustrating the active matrix-type liquid crystal display device according to the embodiment. Reference numeral 1301 denotes a source signal line drive circuit which receives clock signals (S-CLK. S-CLKb), a start pulse (S-SP), a right-and-left scanning direction change-over signal (L/R) and video signals (video data). Reference numeral 1302 denotes a gate signal line drive circuit which receives clock signals (G-CLK, G-CLKb), a start pulse (G-SP), an up-and-down scanning direction change-over signal (U/D) and buffer control signals (G-CS). Reference numeral 1303 denotes a pixel unit having pixels arranged like a matrix at the intersecting points of the gate signal lines 1304 and source signal lines 1305. Each pixel has a pixel TFT 1306. Further, a pixel electrode (not shown) and a holding capacity 1307 are connected to either the source region or the drain region of the pixel TFT. Further, reference numeral 1308 denotes liquid crystals held between the active matrix substrate and the opposing substrate (not shown). Reference numeral 1309 denotes a video signal line which receives video signals (video data) from an external unit.

Figure 14:
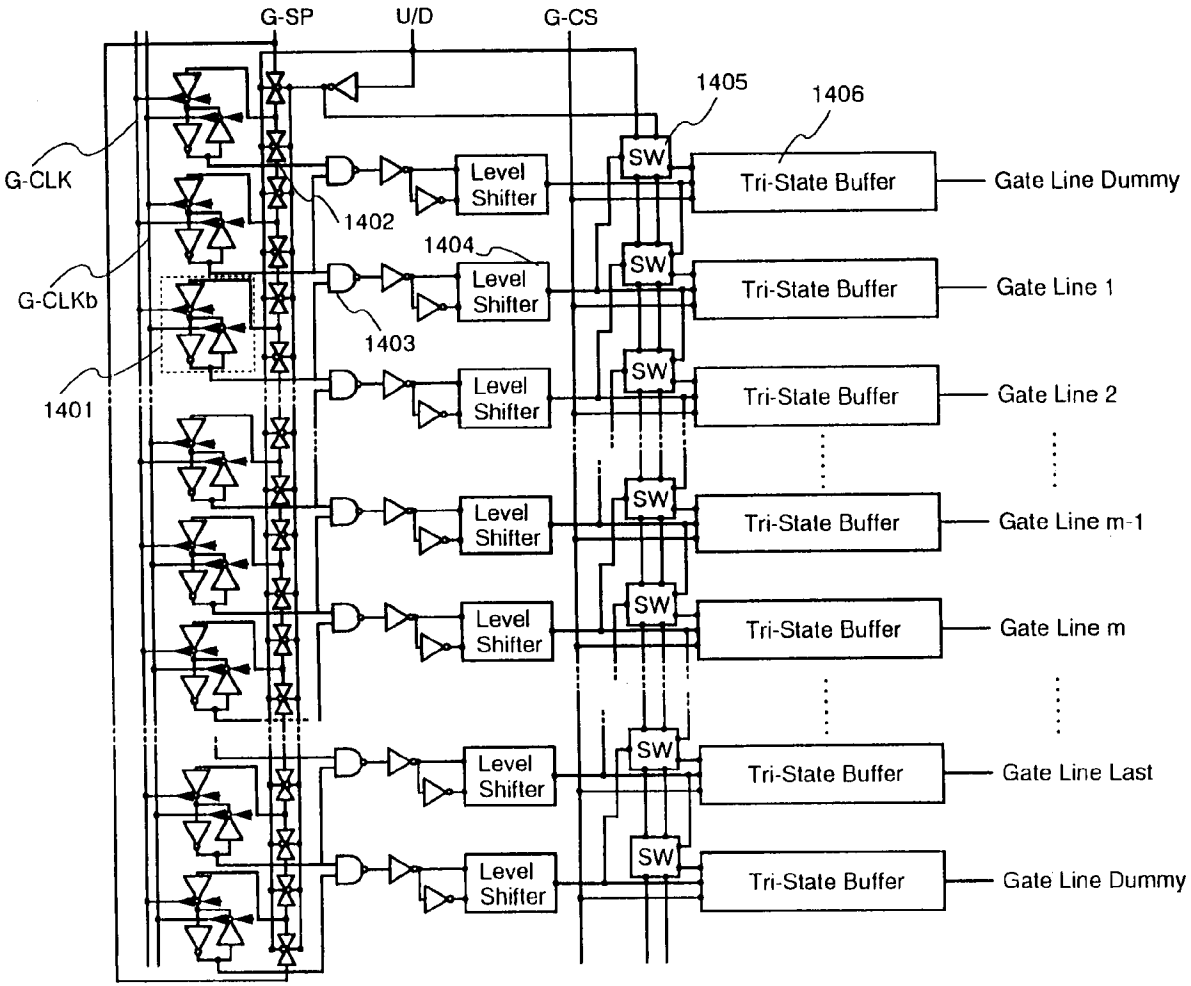
FIG. 14 is a diagram of a gate signal line drive circuit in the active matrix-type semiconductor display device according to the embodiment 10.

Reference is made to FIG. 14 which constitutes a gate signal line drive circuit by using the tristate buffer of this invention and, further, constitutes a circuit for effectively changing over the scanning up and down, and includes shift registers 1401, analog switches 1402 for changing over the scanning direction up and down, NAND circuits 1403, level shifters 1404, gate selection pulse change-over switches 1405, and tristate buffers 1406. An inverter and a buffer may be arranged among the NAND circuit, level shifter circuit and buffer.

The method of driving the tristate buffer circuit is the same as the one described in the embodiment 1. This embodiment, however, deals with a method of changing over the scanning direction of the gate signal line drive circuit by using a newly added gate selection pulse change-over switch 2405.

Figure 15:
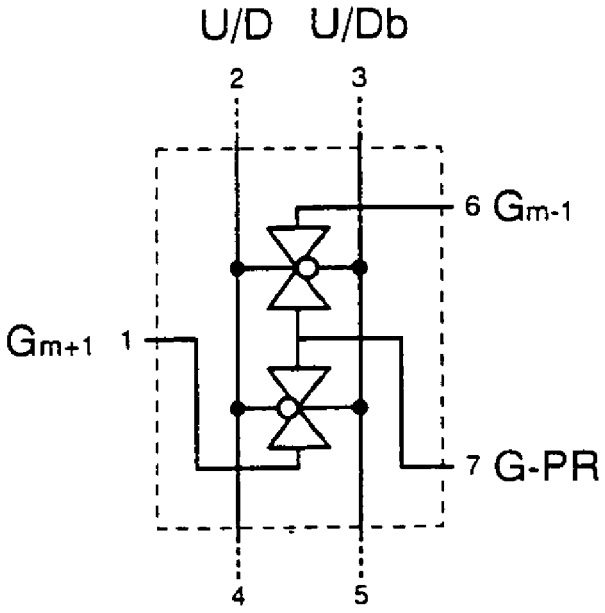
FIG. 15 is a diagram illustrating the circuit constitution of a gate selection pulse change-over switch used in the gate signal line drive circuit in the active matrix-type semiconductor display device according to the embodiment 10.
Figure 15:
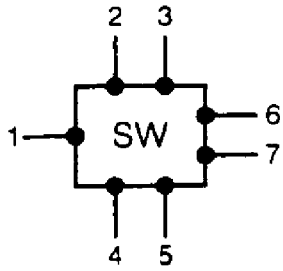

FIG. 15 is a circuit diagram of the gate selection pulse change-over switch. In a block diagram of FIG. 15, reference numerals 1 to 7 attached to the input/output pins correspond to reference numerals of the circuit diagram. Signals input to a switch connected to the tristate buffer of the m-th stage are scanning direction change-over signals (U/D, U/Db), a gate selection pulse ($G_{m-1}$) of a preceding stage that is neighboring and a gate selection pulse ($G_{m+1}$) of a next stage that is neighboring. In an ordinary scanning direction (when Hi is input to U/D), $G_{m-1}$ is selected and is output as G-PR from the output pin 7. When the scanning direction is inverted (when Lo is input to U/D), $G_{m+1}$ is selected and is output as G-PR from the output pin 7. Thus, the tristate buffer can be normally operated even when the scanning direction is inverted.

Embodiment 11

An active matrix semiconductor display device made from a driving circuit of the present invention has various uses. In the present embodiment, a description will be given on a semiconductor device incorporating an active matrix semiconductor display device made from a driving circuit of the present invention. (hereinafter called a semiconductor display device).

The following can be given as examples of these semiconductor devices: a portable information terminal (such as an electronic book, a mobile computer, and an portable telephone), a video camera, a digital camera, a personal computer, a television, and a projector. Examples of those are shown in FIGS. 27, 28 and 29.

Figure 27A:
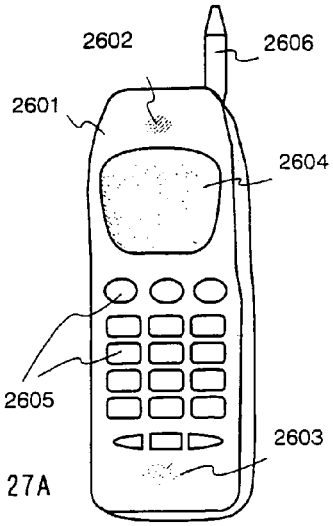
FIGS. 27A to 27F are views illustrating electronic devices incorporating the active matrix-type liquid crystal display device of the invention.

FIG. 27A is a portable telephone, and is composed of a main body 2601, an audio output portion 2602, an audio input portion 2603, a display portion 2604, operation switches 2605, and an antenna 2606. The present invention can be applied to the display portion 2604 prepared with an active matrix substrate.

Figure 27B:
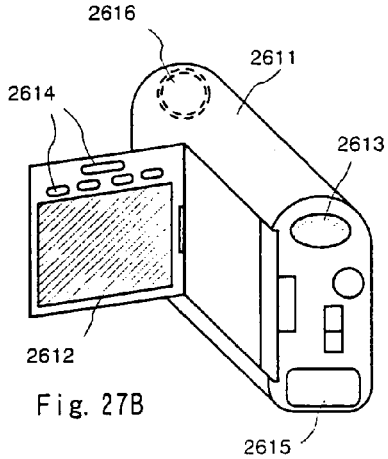

FIG. 27B is a video camera, and is composed of a main body 2611, a display portion 2612, an audio input portion 2613, operation switches 2614, a battery 2615, and an image receiving portion 2616. The present invention can be applied to the display portion 2612 prepared with an active matrix substrate.

Figure 27C:
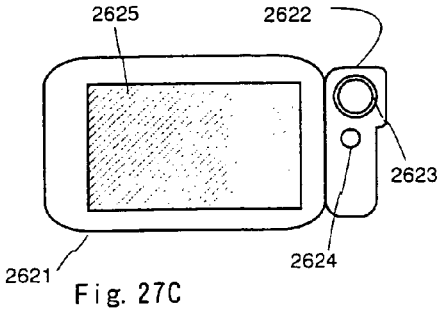

FIG. 27C is a mobile computer or a portable type information terminal, and is composed of a main body 2616 a camera portion 2622, an image receiving portion 2623, operation switches 2624, and a display portion 2625. The present invention can be applied to the display portion 2625 prepared with an active matrix substrate.

Figure 27D:
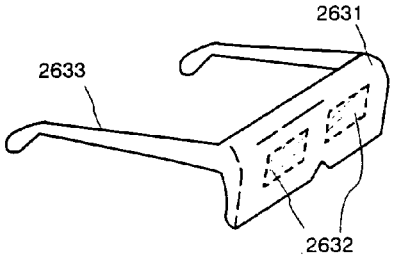

FIG. 27D is a head mount display, and is composed of a main body 2631, a display portion 2632, and an arm portion 2633. The present invention can be applied to the display portion 2632 prepared with an active matrix substrate.

Figure 27E:
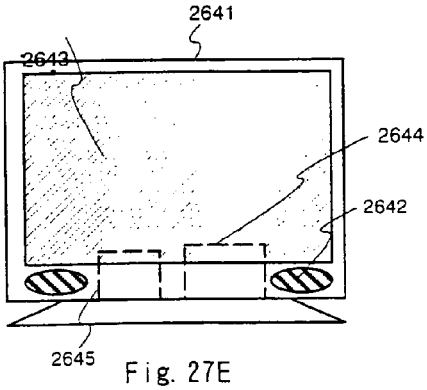

FIG. 27E is a television, and is composed of a main body 2641, speakers 2642, a display portion 2643, a receiving device 2644, and an amplification device 2645. The present invention can be applied to the display portion 2643 prepared with an active matrix substrate.

Figure 27F:
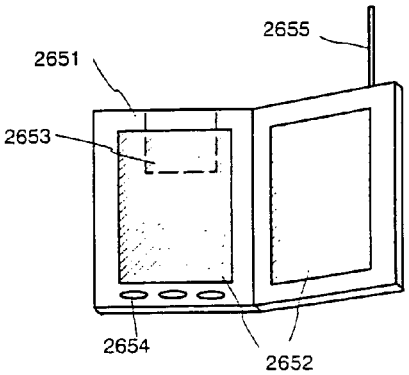

FIG. 27F is a portable electronic book, and is composed of a main body 2651, a display device 2652, a memory medium 2653, an operation switch 2654 and an antenna 2655. The book is used to display data stored in a mini-disk (MD) or a DVD (Digital Versatile Disk), or a data received with the antenna. The present invention can be applied to the display portion 2652 prepared with an active matrix substrate.

Figure 28A:
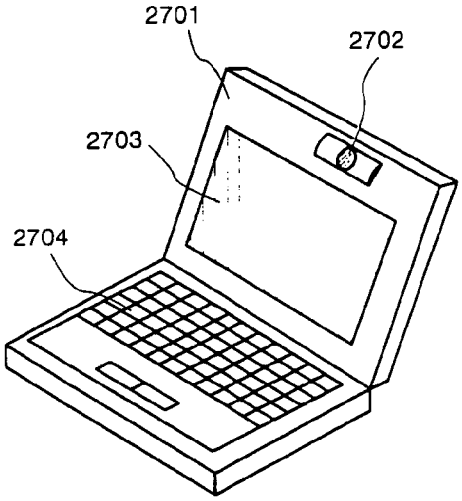
FIGS. 28A to 28D are views illustrating electronic devices incorporating the active matrix-type liquid crystal display device of the invention.

FIG. 28A is a personal computer, and is composed of a main body 2701, an image inputting portion 2702, a display device 2703 and a keyboard 2704. The present invention can be applied to the display portion 2703 prepared with an active matrix substrate.

Figure 28B:
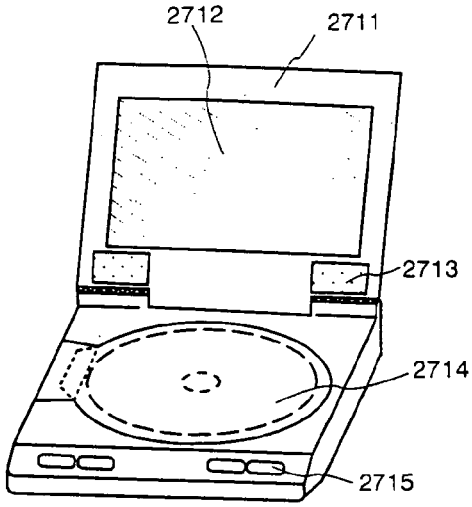

FIG. 28B is a player that employs a recording medium in which programs are recorded, and is composed of a main body 2711, a display portion 2712, a speaker portion 2713, a recording medium 2714, and an operation switch 2715. Note that this player uses a DVD (Digital Versatile Disc), CD and the like as the recording medium to appreciate music and films, play games, and connect to the Internet. The present invention can be applied to the display portion 2612 prepared with an active matrix substrate.

Figure 28C:
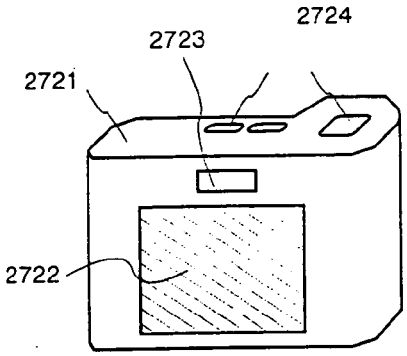

FIG. 28C is a digital camera comprising a main body 2721, a display portion 2722, an eye piece 2723, operation switches 2724, and an image receiving portion (not shown). The present invention can be applied to the display portion 2722 prepared with an active matrix substrate.

Figure 28D:
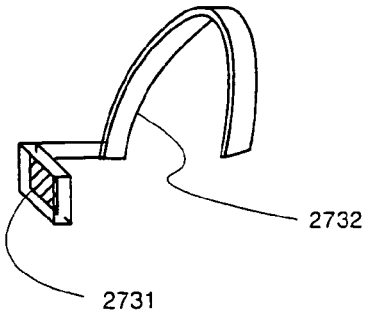

FIG. 28D is a head mount display comprising a display portion 2731, and a band portion 2732. The present invention can be applied to the display portion 2731 prepared with an active matrix substrate.

Figure 29A:
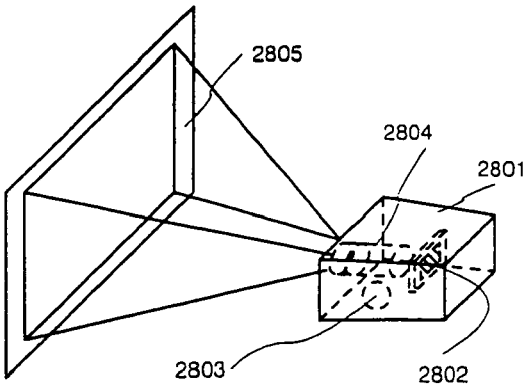
FIGS. 29A to 29D are diagrams illustrating examples of when the active matrix-type liquid crystal display device of the invention is incorporated in a front-type projector and in a rear-type projector.

FIG. 29A is a front-type projector comprising a projection device 2801, a semiconductor display device 2802, a light source 2803, an optical system 2804 and a screen 2805. Note that the projection device 2801 may be applied to a single plate type and may be also applied to a three plate type corresponding to respective colors of R (red), G (green) and B (blue). The present invention is applicable to the semiconductor display device 2802 prepared with an active matrix substrate.

Figure 29B:
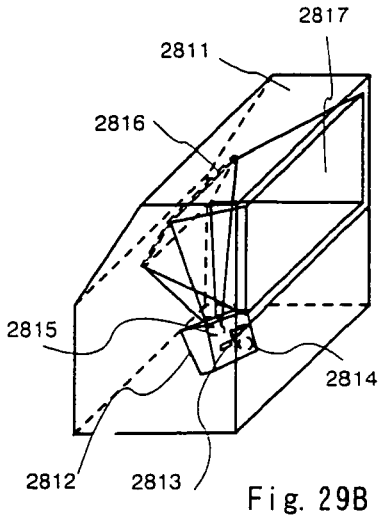

FIG. 29B is a rear-type projector comprising a main body 2811, a projection device 2812, a semiconductor display device 2813, a light source 2814, an optical system 2815, a reflector 2816, and a screen 2817. Note that the projection device 2813 may be applied to a single plate type and may be applied also to a three plate type corresponding to respective colors of R (red), G (green) and B (blue). The present invention is applicable to the semiconductor display device 2813 prepared with an active matrix substrate.

Figure 29C:
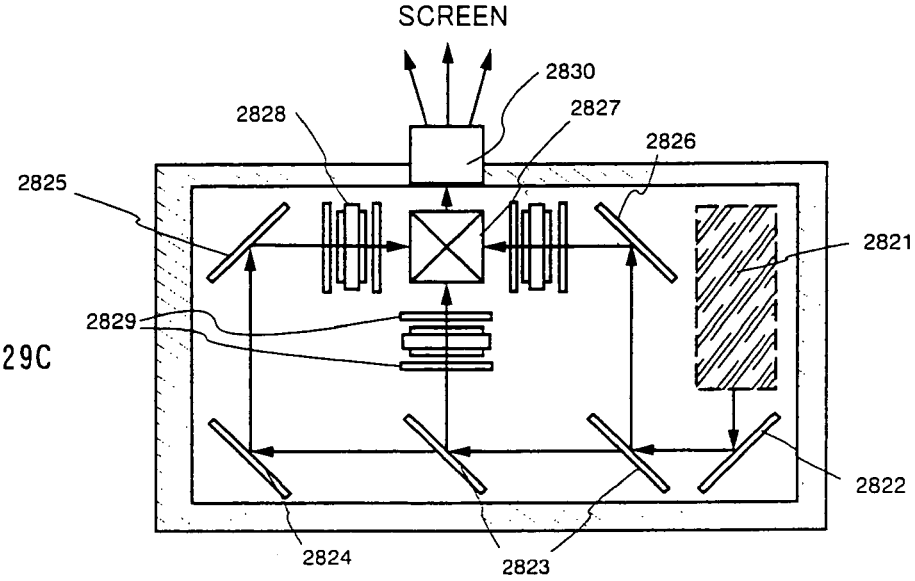

Note that FIG. 29C is a diagram showing an example of the structure of the projection devices 2801. 2812 in FIGS. 29A and 29B. The projection device 2801 or 2812 comprises a light source optical system 2821, mirrors 2822, 2824 to 2826, dichroic mirrors 2823, a prism 2827, semiconductor display devices 2828, phase difference plates 2829, and a projection optical system 2830. The projection optical system 2830 is composed of an optical system including a projection lens. This embodiment shows an example of three plates type but not particularly limited thereto. For instance, the invention may be applied to a single plate type. Further, in the light path indicated by an arrow in FIG. 29C, an optical system such as an optical lens, a film having a polarization function, a film for adjusting a phase difference, and an IR film may be suitably provided by a person who carries out the invention.

Figure 29D:
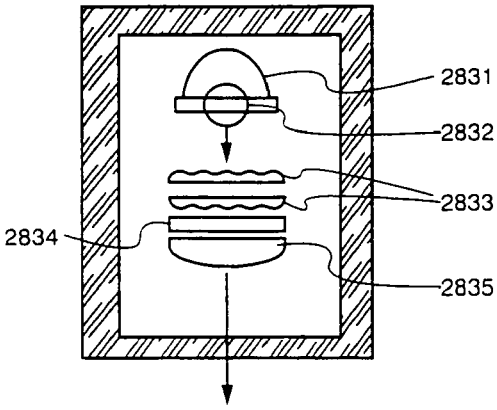

Further, FIG. 29D is a diagram showing an example of the structure of the light source optical system 2821 in FIG. 29C. In this embodiment, the light source optical system 2821 in FIG. 29C comprises a reflector 2831, a light source 2832, lens arrays 2833, a polarization conversion element 2834, and a condenser lens 2835. The light source optical system shown in FIG. 29D is merely an example, and is not particularly limited to the illustrated structure. For example, a person who carries out the invention is allowed to suitably add an optical system such as an optical lens, a film having a polarization function, a film for adjusting a phase difference, and an IR film to the light source optical system.

Use of the tristate buffer of the invention makes it possible to avoid the leakage of the stored electric charge caused by a sudden increase in the off leakage current during the inverse gate biasing that inevitably occurs in the poly-Si TFT, and, hence, the opposing common inverse drive can be normally conducted.

By using the tristate buffer of the invention, further, amplitude can be imparted to the opposing common potential while maintaining the ON/OFF margin in the voltage across gate and source of the pixel TFT. This makes it possible to decrease the amount of electric power consumed by the source signal line drive circuit while maintaining the gate voltage applied to the pixel TFT near the conventionally employed voltage (maintaining the gate breakdown voltage) and, besides, to improve reliability of the TFT as a result of lowering the voltage.

What is claimed is:

1. A portable information terminal having a display device, the display device comprising:

a source signal line drive circuit unit constituted by plural thin-film transistors;

a gate signal line drive circuit unit constituted by plural thin-film transistors; and a pixel unit in which plural pixel thin-film transistors are arranged in a matrix shape, wherein the gate signal line drive circuit unit has at least one tristate buffer and one gate selection pulse change-over switch per a gate signal line;

wherein the tristate buffer comprises a first circuit including a pair of n-channel thin-film transistor and p-channel thin-film transistor; and a second circuit including a pair of n-channel thin-film transistor and p-channel thin-film transistor, wherein the source region of the n-channel thin-film transistor in the first circuit is electrically connected, at a first connection point, to the source region of the p-channel thin-film transistor of the second circuit, wherein a first power source is electrically connected to the source region of the p-channel thin-film transistor of the first circuit, wherein a second power source having a potential lower than that of the first power source is electrically connected to the first connection point, wherein a third power source having a potential lower than the second power source is electrically connected to the source region of the n-channel thin-film transistor of the second circuit, and wherein an output signal line of the first circuit and an output signal line of the second circuit are both electrically connected to the gate signal line at a second connection point.

2. The portable information terminal according to claim 1, wherein the portable information terminal is selected from the group consisting of a portable telephone, a mobile computer and an electronic book.

3. A portable information terminal having a display device, the display device comprising:

a source signal line drive circuit unit formed over a substrate; and a gate signal line drive circuit unit formed over the substrate, wherein the gate signal line drive circuit unit has at least one tristate buffer and one gate selection pulse change-over switch per a gate signal line, wherein the tristate buffer comprises:

at least a first circuit and a second circuit;

a first power source electrically connected to said first circuit;

a second power source having a potential lower than that of said first power source; and a third power source having a potential lower than that of said second power source and electrically connected to said second circuit.

4. The portable information terminal according to claim 3, wherein the portable information terminal is selected from the group consisting of a portable telephone, a mobile computer and an electronic book.

5. A portable information terminal having a display device, the display device comprising: source signal line drive circuit unit formed over a substrate; and a gate signal line drive circuit unit formed over the substrate, wherein the gate signal line drive circuit unit has tristate buffers and gate selection pulse change-over switches, wherein at least one of the tristate buffers is connected to a dummy gate signal line.

6. The portable information terminal according to claim 5, wherein the portable information terminal is selected from the group consisting of a portable telephone, a mobile computer and an electronic book.

7. A portable information terminal having a display device, the display device comprising:

a source signal line drive circuit unit formed over a substrate; and a gate signal line drive circuit unit formed over the substrate, wherein the gate signal line drive circuit unit has tristate buffers and gate selection pulse change-over switches, wherein at least one of the tristate buffers is connected to a dummy gate signal line, and wherein each of the tristate buffers comprises:

at least a first circuit and a second circuit;

a first power source electrically connected to the first circuit;

a second power source having a potential lower than that of the first power source; and a third power source having a potential lower than that of the second power source and electrically connected to the second circuit.

8. The portable information terminal according to claim 7, wherein the portable information terminal is selected from the group consisting of a portable telephone, a mobile computer and an electronic book.

9. A portable information terminal having a display device, the display device comprising:

a source signal line drive circuit unit formed over a substrate;

a gate signal line drive circuit unit formed over the substrate;

a pixel unit formed over the substrate; and tristate buffers formed in the gate signal line drive circuit unit, wherein at least one of the tristate buffers is connected to a dummy gate signal line, wherein each of the tristate buffers comprises a first circuit including a pair of n-channel thin-film transistor and p-channel thin-film transistor, and a second circuit including a pair of n-channel thin-film transistor and p-channel thin-film transistor, wherein the source region of the n-channel thin-film transistor in the first circuit is electrically connected at a first connection point, to the source region of the p-channel thin-film transistor of the second circuit, wherein a first power source is electrically connected to the source region of the p-channel thin-film transistor of the first circuit, wherein a second power source having a potential lower than that of the first power source is electrically connected to the first connection point, wherein a third power source having a potential lower than the second power source is electrically connected to the source region of the n-channel thin-film transistor of the second circuit, and wherein an output signal line of the first circuit and an output signal line of the second circuit are both electrically connected to the gate signal line at a second connection point.

10. The portable information terminal according to claim 9, wherein the portable information terminal is selected from the group consisting of a portable telephone, a mobile computer and an electronic book.

* * * * *